US006773561B1

(12) United States Patent
Noaki et al.

(10) Patent No.: US 6,773,561 B1
(45) Date of Patent: Aug. 10, 2004

(54) UNIT CELL FOR ALKALI CHLORIDE METAL AQUEOUS SOLUTION ELECTROLYTIC TANK

(75) Inventors: Yasuhide Noaki, Nobeoka (JP); Saburo Okamoto, Miyazaki-ken (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 113 days.

(21) Appl. No.: 10/019,948

(22) PCT Filed: Aug. 28, 2000

(86) PCT No.: PCT/JP00/05791

§ 371 (c)(1),
(2), (4) Date: Jan. 7, 2002

(87) PCT Pub. No.: WO01/16398

PCT Pub. Date: Aug. 3, 2001

(30) Foreign Application Priority Data

Aug. 27, 1999 (JP) ..... 11-242002
Aug. 30, 1999 (JP) ..... 11-242759

(51) Int. Cl.[7] ..... C25B 9/20
(52) U.S. Cl. ..... 204/256
(58) Field of Search ..... 204/254, 256, 204/258

(56) References Cited

U.S. PATENT DOCUMENTS

| | | | |
|---|---|---|---|
| 4,111,779 A | 9/1978 | Seko et al. | |
| 4,295,953 A | 10/1981 | Fuseya et al. | |
| 4,602,984 A | 7/1986 | Beaver et al. | |
| 4,734,180 A | 3/1988 | Sato et al. | |
| 5,225,060 A | 7/1993 | Noaki et al. | |
| 5,571,390 A | 11/1996 | Kimura et al. | |

FOREIGN PATENT DOCUMENTS

| | | | |
|---|---|---|---|
| JP | 59-153376 U | 10/1984 | |
| JP | 61-019789 A | 1/1986 | |
| JP | 63-011686 A | 1/1988 | |
| JP | 4-289158 A | 10/1992 | |
| JP | 4-350190 A | 12/1992 | |
| JP | 5-320970 A | 12/1993 | |
| JP | 10-110287 A | 3/1999 | |
| JP | 11-071693 A | 3/1999 | |
| WO | WO 98/55670 A1 * | 12/1998 | ..... C25B/9/00 |

* cited by examiner

*Primary Examiner*—Roy King
*Assistant Examiner*—Harry D Wilkins, III
(74) *Attorney, Agent, or Firm*—Birch, Stewart, Kolasch & Birch LLP

(57) ABSTRACT

Disclosed is a unit cell for use in a bipolar, filter press type electrolytic cell comprising a plurality of unit cells arranged in series through a cation exchange membrane disposed between respective adjacent unit cells, each unit cell comprising anode-side and cathode-side pan-shaped bodies having anode-side and cathode-side gas-liquid separation chambers respectively extending over the entire lengths of the upper sides of anode and cathode compartments, wherein the anode-side and cathode-side gas-liquid separation chambers have perforated bottom walls separating the anode-side and cathode-side gas-liquid separation chambers from the anode and cathode compartments, respectively, wherein a bubble removing partition wall is disposed at least in the anode-side gas-liquid separation chamber of both gas-liquid separation chambers and extends upwardly of the perforated bottom wall of the gas-liquid separation chamber and along the entire length of the gas-liquid separation chamber to partition the gas-liquid separation chamber into first and second passages A and B respectively formed in a perforated area and a non-perforated area of the bottom wall, wherein passage B communicates with a gas and liquid outlet nozzle, and wherein the bubble removing partition wall has an apertured segment having apertures which are positioned at least 10 mm above the inside surface of the bottom wall of the gas-liquid separation chamber.

4 Claims, 10 Drawing Sheets

FIG.4
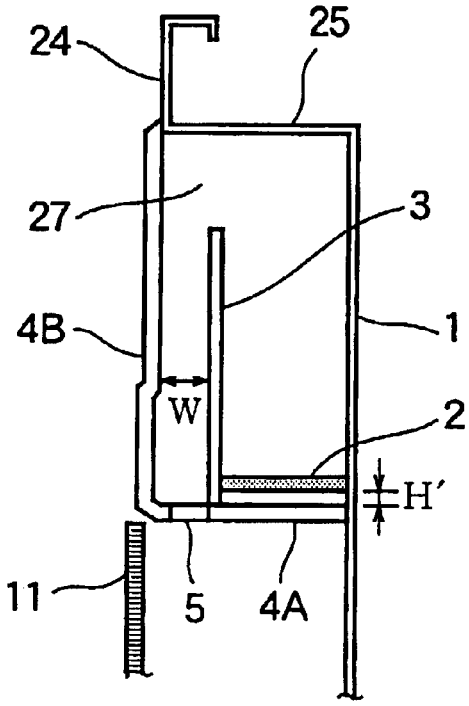
FIG.5 (Comparative)
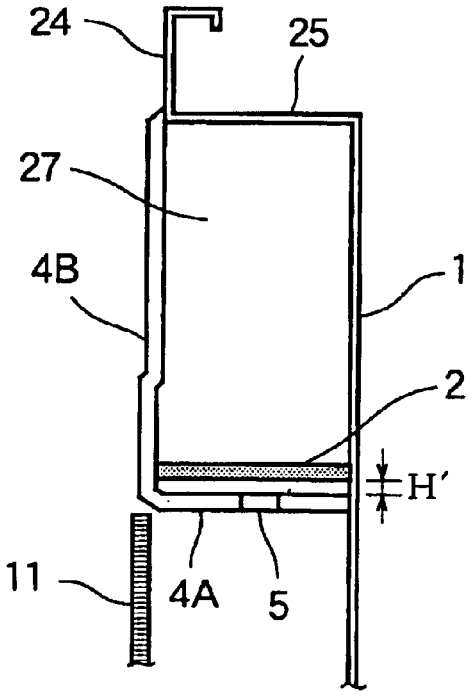

UNIT CELL FOR ALKALI CHLORIDE METAL AQUEOUS SOLUTION ELECTROLYTIC TANK

This application is the national phase under 35 U.S.C. § 371 of PCT International Application No. PCT/JP00/05791 which has an International filing date of Aug. 28, 2000, which designated the United States of America.

BACKGROUND OF THE INVENTION

1. Field of the Invention

The present invention relates to a unit cell for use in a bipolar, filter press type, aqueous alkali metal chloride solution electrolytic cell. More particularly, the present invention is concerned with an improvement in and relating to a unit cell for use in a bipolar, filter press type, aqueous alkali metal chloride solution electrolytic cell comprising a plurality of unit cells which are arranged in series through a cation exchange membrane disposed between respective adjacent unit cells, each unit cell comprising: an anode-side pan-shaped body having an anode compartment and an anode-side gas-liquid separation chamber which extends over the entire length of the upper side of the anode compartment, and a cathode-side pan-shaped body having a cathode compartment and a cathode-side gas-liquid separation chamber which extends over the entire length of the upper side of the cathode compartment, wherein the anode-side pan-shaped body and the cathode-side pan-shaped body are disposed back to back, wherein the anode-side and cathode-side gas-liquid separation chambers have perforated bottom walls separating the anode-side and cathode-side gas-liquid separation chambers from the anode compartment and the cathode compartment, respectively. The improvement comprises a bubble removing partition wall which is disposed at least in the anode-side gas-liquid separation chamber of the anode-side and cathode-side gas-liquid separation chambers and which extends upwardly of the perforated bottom wall of the gas-liquid separation chamber, wherein the bubble removing partition wall extends along the entire length of the gas-liquid separation chamber to partition the gas-liquid separation chamber into a first passage A formed on the bottom wall in a perforated area thereof and a second passage B which is formed on the bottom wall in a non-perforated area thereof and which communicates with a gas and liquid outlet nozzle, and wherein the bubble removing partition wall has an apertured segment and, the apertures of the apertured segment of the bubble removing partition wall are positioned at least 10 mm above the inside surface of the bottom wall of the gas-liquid separation chamber.

The unit cell of the present invention is advantageous in that a gas and an electrolytic solution can be discharged in a condition wherein the gas and the electrolytic solution are substantially completely separated from each other. Therefore, the electrolytic cell which employs the unit cell of the present invention has an advantage in that, even when an electrolysis is performed at high current density, the occurrence of a breakage of an ion exchange membrane due to vibrations in the electrolytic cell can be suppressed.

2. Prior Art

In general, for stably performing the electrolysis of an alkali metal chloride to enable low-cost production of chlorine, hydrogen and an alkali metal hydroxide, it is required that the cost of equipment be low, that the electrolytic voltage be low, that vibrations or the like in the electrolytic cell do not cause a breakage of an ion exchange membrane, and that the concentration distribution of an electrolytic solution in an electrode compartment be narrow, thereby causing the voltage and the current efficiency of an ion exchange membrane to be stable for a prolonged period of time, and so on.

In recent years, in accordance wit the above-mentioned requirements, remarkable progress has been made in the technology for the electrolysis of an alkali metal chloride using an ion exchange membrane (i.e., the technology for the ion exchange membrane electrolysis). The improvements are especially remarkable in the performances of the ion exchange membranes, electrodes and electrolytic cells. At the time the ion exchange membrane electrolysis was introduced for the first time, the electricity consumption of the ion exchange membrane electrolysis performed at a current density of 30 A/dm$^2$ was as large as 2,600 kW per ton of NaOH produced. However, as a result of the above-mentioned great progress in the art in recent years, the electricity consumption of the ion exchange membrane electrolysis performed at a current density of 30 A/dm$^2$ has been reduced to about 2,000 kW or less per ton of NaOH produced. On the other hand, it has recently been strongly desired that the size of the equipment for performing the electrolysis is increased, energy is saved, and efficiency is increased. In addition, it has also been desired for the electrolysis to be able to be performed at a current density as high as 50 A/dm$^2$ or more, which is far higher than the above-mentioned current density 30 A/dm$^2$ which was the possible maximum value at the time of the introduction of the ion exchange membrane electrolysis.

However, when the electrolysis is performed at high current density, the amount of a gas formed is increased, causing an increase in the pressure fluctuations in the electrolytic cell, so that vibrations are likely to be generated in the electrolytic cell. When the electrolysis at high current density is performed for a long time, there has conventionally been posed a problem in that the vibrations in the electrolytic cell can cause a breakage of an ion exchange membrane.

Especially, in the anode compartment of the unit cell of an alkali metal chloride electrolytic cell, gas bubbles have a great influence. For example, when the electrolysis is performed under electrolysis conditions wherein the current density is 40 A/dm$^2$, the reaction pressure is 0.1 MPa, and the reaction temperature is 90 ° C., the upper portion of the anode compartment is filled with gas bubbles, so that the electrolytic solution in the upper portion of the anode compartment is likely to have portions containing gas bubbles in an amount as large as 80 % by volume or more. The ratio of such high bubble content portions in the electrolytic solution tends to be increased in accordance with an increase in the current density.

Such portion of the electrolytic solution wherein the gas/liquid ratio is high has poor fluidity. Therefore, when the electrolytic solution in the cell has a portion having high gas/liquid ratio, the electrolytic solution has poor circulation, so that not only is the concentration of the electrolytic solution locally lowered but also the gas is likely to be stagnated in the electrolytic cell. The ratio of a portion of the electrolytic solution having high gas/liquid ratio can be decreased to some extent by a method in which the electrolysis pressure is increased or the amount of the electrolytic solution circulated is greatly increased. However, such a method for decreasing the ratio of a portion of the electrolytic solution having high gas/liquid ratio poses problems in that safety is sacrificed and the cost for equipment becomes high.

Conventionally, many proposals have been made with respect to the unit cell for the ion exchange membrane electrolysis of an alkali metal chloride, in which a high purity alkali metal hydroxide can be produced at high current density. For example, these proposals are made in Unexamined Japanese Patent Application Laid-Open Specification No. 51-43377 (corresponding to U.S. Pat. No. 4,111,779), Unexamined Japanese Patent Application Laid-Open Specification No. 62-96688 (corresponding to U.S. Pat. No. 4,734,180), and Japanese Patent Application prior-to-examination Publication (kohyo) No. 62-500669 (corresponding to U.S. Pat. No. 4,602,984). The unit cells disclosed in these patent documents have a defect in that, in the operation of these unit cells, the withdrawal of a gas and a liquid from an upper portion of the cells is performed in a condition wherein the gas and the liquid get mixed with each other, so that vibrations occur in the cell and the vibrations cause a breakage of an ion exchange membrane. Further, these unit cells are not adapted for facilitating the circulation of the electrolytic solution therein. Therefore, for rendering narrow the concentration distribution of the electrolytic solution in the cells, it is necessary to circulate a large amount of an electrolytic solution.

Unexamined Japanese Patent Application Laid-Open Specification No. 61-19789 and U.S. Pat. No. 4,295,953 disclose a unit cell in which a cell frame has a hollow structure and is of a picture frame-like shape, and an electrically conductive distributor is disposed between an electrode plate and an electrode sheet, wherein the distributor is intended to serve as a path for the downward flow of an electrolytic solution. Unexamined Japanese Patent Application Laid-Open Specification No. 63-11686 discloses a unit cell in which a cell frame has a hollow structure and is of a picture frame-like shape, and a cylindrical member for electrical current distribution is provided, wherein the cylindrical member is intended to serve as a path for the downward flow of an electrolytic solution. In these prior art techniques, an improved circulation of an electrolytic solution in the cells can be attained, but when the electrolysis is conducted at a high current density, it is likely that vibrations occur around an outlet for a gas and liquid and that a gas is stagnated in the upper portion of the cells. Further, these techniques have a problem in that the cells have a complicated structure. Unexamined Japanese Utility Model Application Laid-Open Specification No. 59-153376 proposes a method for preventing the occurrence of vibrations in an electrolytic cell, which comprises disposing a mesh body for preventing bubble growth in the upper portion (near the liquid surface of the electrolytic solution) of the electrode compartment. However, by this method, a gas-liquid separation cannot be satisfactorily performed, so that this method cannot completely prevent the occurrence of vibrations due to the pressure fluctuations in the electrolytic cell.

Unexamined Japanese Patent Application Laid-Open Specification No. 4-289184 (corresponding to U.S. Pat. No. 5,225,060) discloses an electrolytic cell employing a unit cell which contains anode-side and cathode-side gas-liquid separation chambers respectively disposed in anode-side and cathode-side non-current-flowing spaces and extending over the entire lengths of the upper sides of the anode and cathode compartments, wherein each of the gas-liquid separation chambers has a gas and liquid outlet nozzle, which opens downwardly so that a gas and liquid having been separated from each other by the gas-liquid separation chamber can be discharged while maintaining the gas-liquid separated state. Further, the above-mentioned Unexamined Japanese Patent Application Laid-Open Specification No. 4-289184 also teaches a method in which an L-shaped duct is disposed in at least one of the anode compartment and the cathode compartment, wherein the duct is intended to promote the circulation of an electrolytic solution in the electrode compartment. In the case of the use of the above-mentioned electrolytic cell, when the electrolysis is performed at a current density of 45A/dm$^2$ or less, advantages can be obtained in that the occurrence of vibrations is relatively small and the concentration distribution of an electrolytic solution in the electrode compartment is narrow. However, when the electrolysis is performed, for example, at a current density as high as 50 A/dm$^2$ or more by using the above-mentioned electrolytic cell, an extremely great amount of gas bubbles are formed in the electrolytic cell. As a result, a satisfactory gas-liquid separation cannot be effected, so that problems are posed in that great vibrations are caused to occur, thus adversely affecting an ion exchange membrane, and the concentration distribution of the electrolytic solution becomes broad.

Unexamined Japanese Patent Application Laid-Open Specification No. 8-100286 (corresponding to U.S. Pat. No. 5,571,390) proposes that a number of vertically extending ducts (downcomers) are disposed in the electrode compartments of a unit cell which contains gas-liquid separation chambers, such as the unit cell as already described above. However, even the unit cell (containing downcomers) proposed in this patent document poses a problem in that, when the electrolysis is performed at a current density as high as 5 A/dm$^2$ or more, the gas-liquid separation becomes unsatisfactory and, hence, great vibrations are caused to occur, thus adversely affecting an ion exchange membrane.

SUMMARY OF THE INVENTION

In this situation, the present inventors have made extensive and intensive studies with a view toward developing a unit cell for use in a bipolar, filter press type electrolytic cell used for performing the ion exchange membrane electrolysis, wherein the unit cell is advantageous in that a gas and an electrolytic solution can be discharged in a condition wherein the gas and the electrolytic solution are substantially completely separated from each other, so that, even when the electrolysis is performed at a current density as high as 50 A/dm$^2$ or more, the occurrence of vibrations in the cell can be prevented, thereby preventing the occurrence of a breakage of an ion exchange membrane. As a result, it has surprisingly been found that discharge of a gas and a liquid in a substantially completely gas-liquid separated condition can be achieved when the electrolysis of an aqueous alkali metal chloride solution is performed by using a bipolar, filter press type electrolytic cell which employs a unit cell comprising: an anode-side pan-shaped body having an anode compartment and an anode-side gas-liquid separation chamber which extends over the entire length of the upper side of the anode compartment, and a cathode-side pan-shaped body having a cathode compartment and a cathode-side gas-liquid separation chamber which extends over the entire length of the upper side of the cathode compartment, wherein the anode-side pan-shaped body and the cathode-side pan-shaped body are disposed back to back, wherein the anode-side and cathode-side gas-liquid separation chambers have perforated bottom walls separating the anode-side and cathode-side gas-liquid separation chambers from the anode compartment and the cathode compartment, respectively, wherein a bubble removing partition wall having an apertured segment is disposed at least in the anode-side gas-liquid separation chamber of the anode-side and cathode-side gas-liquid separation chambers and extends upwardly of the perforated bottom wall of the gas liquid separation chamber, wherein the bubble removing partition wall extends along the entire length of the gas-liquid separation chamber to partition the gas-liquid separation chamber into a first passage A formed on the bottom wall in a perforated area thereof and a second passage B which is formed on the bottom wall in a non-perforated area thereof and which communicates with a gas and liquid outlet nozzle, and wherein the apertures of the apertured segment of the bubble removing partition wall are positioned at least 10 mm above the inside surface of the bottom wall of the gas-liquid separation chamber. The present invention has been completed, based on this novel finding.

Accordingly, it is an object of the present invention to provide a unit cell for use in a bipolar, filter press type electrolytic cell, wherein the unit cell is advantageous in that a gas and an electrolytic solution can be discharged in a condition wherein the gas and the electrolytic solution are substantially completely separated from each other, so that, even when the electrolysis is performed at a current density as high as 50 $A/dm^2$ or more, the occurrence of vibrations in the cell can be prevented, thereby preventing the occurrence of a breakage of an ion exchange membrane.

The foregoing and other objects, features and advantages of the present invention will be apparent from the following detailed description and appended claims taken in connection with the accompanying drawings.

BRIEF DESCRIPTION OF THE DRAWINGS

In the drawings;

FIG. 4 is an enlarged, diagrammatic cross-sectional view of still another form of a gas-liquid separation chamber of the unit cell of the present invention;

FIG. 5 (comparative) is an enlarged, diagrammatic cross-sectional view of a gas-liquid separation chamber which has a porous plate horizontally extending therein, instead of the bubble removing partition wall used in the present invention;

Figure 1:
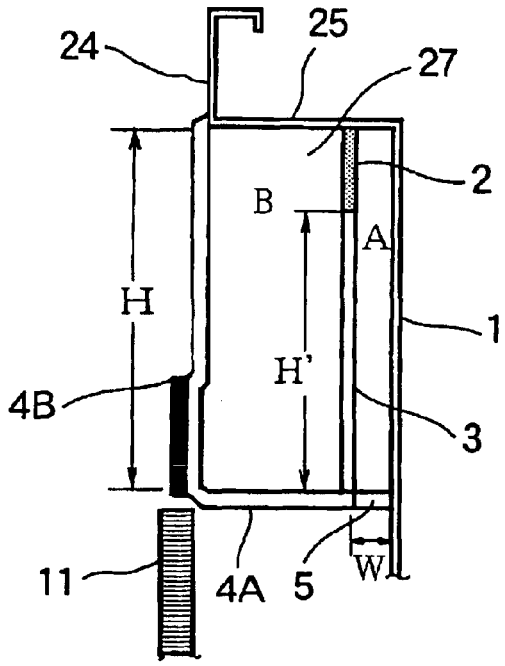
FIG. 1 is an enlarged, diagrammatic cross-sectional view of one form of a gas-liquid separation chamber of the unit cell of the present invention.

| Description of the reference numerals | |
|---|---|
| 1 | Wall |
| 2 | Apertured segment of the bubble removing partition wall |
| 3 | Bubble removing partition wall having apertured segment 2 |
| 4A | Perf orated bottom wall |
| 4B | Side wall |
| 5 | Perforation |
| 6 | Hole in a rib |
| 7 | Inlet nozzle of a distributor |
| 8 | Gas and liquid outlet nozzle of an anode compartment |
| 8' | Gas and liquid outlet nozzle of a cathode compartment |
| 9 | Conductive rib |
| 10 | Inlet nozzle of an anode compartment |
| 10' | Inlet nozzle of a cathode compartment |
| 11 | Electrode |
| 12 | Reinforcing rib |
| 13 | Anode |
| 14 | Cathode |
| 15 | Lead plate |
| 16 | Cathode-side gasket |
| 17 | Cation exchange membrane |
| 18 | Anode-side gasket |
| 19 | Bipolar unit cell |
| 20 | Fastening frame |
| 21 | Baffle plate |
| 22 | Slit-like gap formed between the lower end portion of baffle plate 21 and the inside surface of wall 1 |
| 23 | Electrolytic solution feed hole |
| 24 | Crooked flange |
| 25 | Frame wall |
| 26 | Engaging bar |
| 27 | Gas-liquid separation chamber |
| 28 | Distributor |
| 29 | Anode-side unit cell |
| 30 | Cathode-side unit cell |

In FIGS. 1 through 14, like parts or portions are designated by like numerals and characters.

DETAILED DESCRIPTION OF THE INVENTION

According to the present invention, there is provided a unit cell for use in a bipolar, filter press type, aqueous alkali metal chloride solution electrolytic cell comprising a plurality of unit cells which are arranged in series through a cation exchange membrane disposed between respective adjacent unit cells, each unit cell comprising:

an anode-side pan-shaped body having an anode compartment and an anode-side gas-liquid separation chamber which is disposed in an anode-side non-current flowing space left above the anode compartment and extends over the entire length of the upper side of the anode compartment, and a cathode-side pan-shaped body having a cathode compartment and a cathode-side gas-liquid separation chamber which is disposed in a cathode-side non-current flowing space left above the cathode compartment and extends over the entire length of the upper side of the cathode compartment, the anode-side pan-shaped body and the cathode-side pan-shaped body being disposed back to back, the anode-side and cathode-side gas-liquid separation chambers having perforated bottom walls separating the anode-side and cathode-side gas-liquid separation chambers from the anode compartment and the cathode compartment, respectively, and each of the gas-liquid separation chambers having, at one end thereof, a gas and liquid outlet nozzle, wherein a bubble removing partition wall is disposed at least in the anode-side gas-liquid separation chamber of the anode-side and cathode-side gas-liquid separation chambers and which extends upwardly of the perforated bottom wall of the gas-liquid separation chamber, the bubble removing partition wall extending along the entire length of the gas-liquid separation chamber to partition the gas-liquid separation chamber into a first passage A formed on the bottom wall in a perforated area thereof and a second passage B formed on the bottom wall in a non-perforated area thereof, the bubble removing partition wall having an apertured segment, the apertures of the apertured segment of the bubble removing partition wall being positioned at least 10 mm above the inside surface of the bottom wall of the gas-liquid separation chamber, wherein the second passage B communicates with the gas and liquid outlet nozzle and wherein the second passage B communicates with the anode compartment through the apertured segment and the first passage A.

For easy understanding of the present invention, the essential features and various embodiments of the present invention are enumerated below.

1. In a unit cell for use in a bipolar, filter press type, aqueous alkali metal chloride solution electrolytic cell comprising a plurality of unit cells which are arranged in series through a cation exchange membrane disposed between respective adjacent unit cells, each unit cell comprising:

an anode-side pan-shaped body having an anode compartment and an anode-side gas-liquid separation chamber which is disposed in an anode-side non-current flowing space left above the anode compartment and extends over the entire length of the upper side of the anode compartment, and a cathode-side pan-shaped body having a cathode compartment and a cathode-side gas-liquid separation chamber which is disposed in a cathode-side non-current flowing space left above the cathode compartment and extends over the entire length of the upper side of the cathode compartment, the anode-side pan-shaped body and the cathode-side pan-shaped body being disposed back to back, the anode-side and cathode-side gas-liquid separation chambers having perforated bottom walls separating the anode-side and cathode-side gas-liquid separation chambers from the anode compartment and the cathode compartment, respectively, and each of the gas-liquid separation chambers having, at one end thereof, a gas and liquid outlet nozzle, the improvement comprising a bubble removing partition wall which is disposed at least in the anode-side gas-liquid separation chamber of the anode-side and cathode-side gas-liquid separation chambers and which extends upwardly of the perforated bottom wall of the gas-liquid separation chamber, the bubble removing partition wall extending along the entire length of the gas-liquid separation chamber to partition the gas-liquid separation chamber into a first passage A formed on the bottom wall in a perforated area thereof and a second passage B formed on the bottom wall in a non-perforated area thereof, the bubble removing partition wall having an apertured segment, the apertures of the apertured segment of the bubble removing partition wall being positioned at least 10 mm above the inside surface of the bottom wall of the gas-liquid separation chamber, wherein the second passage B communicates with the gas and liquid outlet nozzle and wherein the second passage B communicates with the anode compartment through the apertured segment and the first passage A.

2. The unit cell according to item 1 above, which further comprises, at least in the anode compartment of the anode and cathode compartments a baffle plate disposed in an upper portion of the anode compartment, wherein the baffle plate is positioned so that an upward flow passage C is formed between the baffle plate and the anode and a downward flow passage D is formed between the baffle plate and a back-side inner wall of the anode compartment.

3. The unit cell according to item 2 above, wherein:

the baffle plate has a height of from 300 mm to 600 mm, the upward flow passage C has a broader width at a lower end thereof than at an upper end thereof, and has a width in the range of from 5 mm to 15 mm as measured at the smallest spacing between the baffle plate and the anode, and the downward flow passage D has a broader width at an upper end thereof than at a lower end thereof, and has a width in the range of from 1 mm to 20 mm as measured at the smallest spacing between the baffle plate and the back-side inner wall of the anode compartment.

4. The unit cell according to any one of items 1 to 3 above, which further comprises, at least in the anode compartment of the anode and cathode compartments, an electrolytic solution distributor having a pipe-like morphology and disposed in a lower portion of the anode compartment, the distributor having a plurality of electrolytic solution feed holes and having an inlet communicating with an electrolytic solution inlet nozzle of the anode compartment, wherein each of the electrolytic solution feed holes has a cross-sectional area such that, during the operation of the unit cell, when a saturated saline solution is supplied as an electrolytic solution through the distributor at a minimum flow rate for conducting an electrolysis at a current density of 40 $A/dm^2$, each electrolytic solution feed hole exhibits a pressure loss of from 50 $mm \cdot H_2O$ to 1,000 $mm \cdot H_2O$.

The present invention will now be described in detail.

The unit cell of the present invention is a unit cell for use in a bipolar, filter press type, aqueous alkali metal chloride solution electrolytic cell.

First, an explanation is made below with respect to the basic structure of the unit cell of the present invention, referring to FIGS. 12 and 13 (explanations on bubble removing partition wall 3 having apertured segment 2, baffle plate 21 and distributor 28 are omitted here and made below, referring to various drawings including the drawings other than FIGS. 12 and 13).

Figure 12:
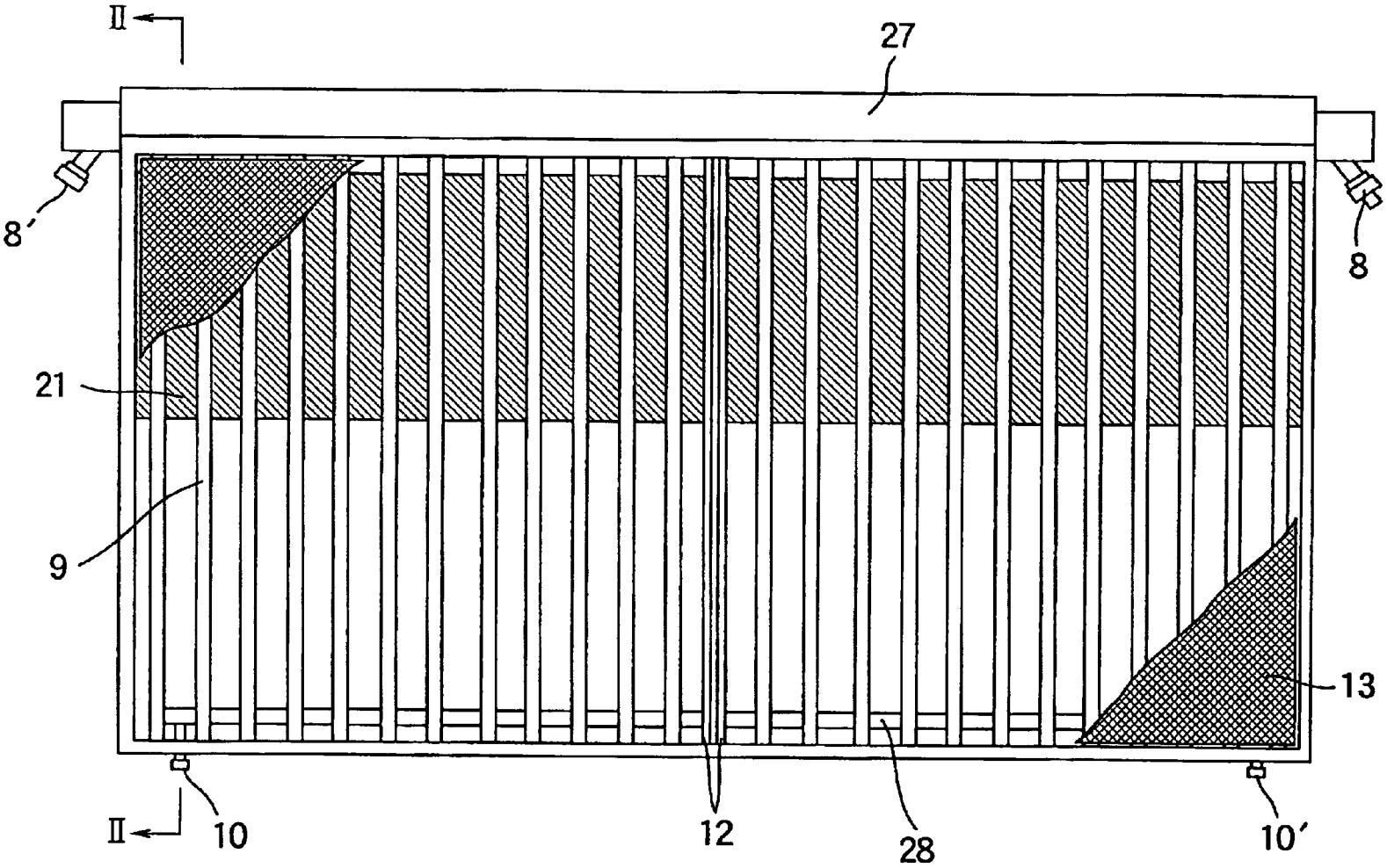
FIG. 12 is a diagrammatic front view of still another embodiment of the unit cell of the present invention as viewed from the anode compartment side, shown with the net-like electrode substantially cut-away.

FIG. 12 is a diagrammatic front view of one embodiment of the unit cell of the present invention as viewed from the anode compartment side, shown with the net-like electrode substantially cut-away. FIG. 13 is a diagrammatic cross-sectional view of the unit cell of FIG. 12, taken along line II—II of FIG. 12.

In the present invention, the term "unit cell" means a single bipolar cell comprising:

an anode-side pan-shaped body having an anode compartment and an anode-side gas-liquid separation chamber which is disposed in an anode-side non-current flowing space left above the anode compartment and extends over the entire length of the upper side of the anode compartment, and a cathode-side pan-shaped body having a cathode compartment and a cathode-side gas-liquid separation chamber which is disposed in a cathode-side non-current flowing space left above the cathode compartment and extends over the entire length of the upper side of the cathode compartment, the anode-side pan-shaped body and the cathode-side pan-shaped body being disposed back to back, the anode-side and cathode-side gas-liquid separation chambers having perforated bottom walls separating the anode-side and cathode-side gas-liquid separation chambers from the anode compartment and the cathode compartment, respectively, and each of the gas-liquid separation chambers having, at one end thereof, a gas and liquid outlet nozzle.

Figure 13:
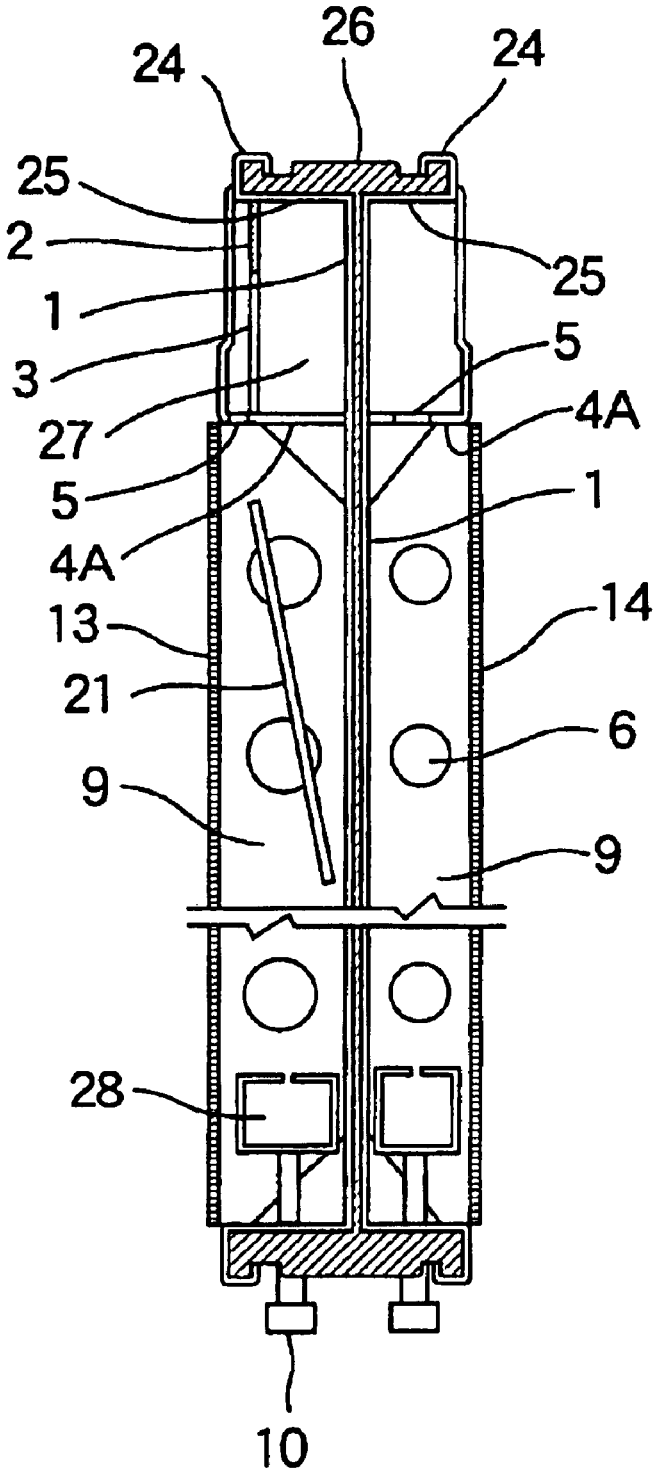
FIG. 13 is a diagrammatic cross-sectional view of the unit cell of FIG. 12, taken along line II—II of FIG. 12.

As shown in FIG. 13, each of the anode-side and cathode-side pan-shaped bodies comprises wall 1, frame wall 25 extending from the periphery of wall 1, and crooked flange 24 having a ⌈-shaped cross-section and extending from frame wall 25.

Crooked flanges 24,24 of the anode-side and cathode-side pan-shaped bodies cooperate with frame walls 25,25 of the anode-side and cathode-side pan-shaped bodies, to thereby form a recess extending through the peripheral portions of the pan-shaped bodies. Into the recess is inserted engaging bar 26 which extends in the depth-wise direction in FIG. 13, such that the anode-side and cathode-side pan-shaped bodies are fixedly held back to back.

Wall 1 of the anode-side pan-shaped body has anode 13 fixed thereto through a plurality of electrically conductive ribs 9 to form an anode compartment with an anode-side non-current-flowing space left above the anode compartment and below the upper-side portion of frame wall 25 of the anode-side pan-shaped body. On the other hand, wall 1 of cathode-side pan-shaped body has cathode 14 fixed thereto through a plurality of electrically conductive ribs 9 to form a cathode compartment with a cathode-side non-current-flowing space left above the cathode compartment and below the upper side portion of frame wall 25 of the cathode-side pan-shaped body. Each of the above-mentioned ribs 9 has holes 6 for the passage of a liquid and a gas therethrough.

Anode-side gas-liquid separation chamber 27 is disposed in the above-mentioned anode-side non-current flowing space left above the anode compartment and extends over the entire length of the upper side of the anode compartment, whereas cathode-side gas-liquid separation chamber 27 is disposed in a cathode-side non-current flowing space left above the cathode compartment and extends over the entire length of the upper side of the cathode compartment.

The above-mentioned anode-side and cathode-side gas-liquid separation chambers 27,27 have perforated bottom walls 4A,4A separating the anode-side and cathode-side gas-liquid separation chambers from the anode compartment and the cathode compartment, respectively. Each of bottom walls 4A,4A has perforations 5, through which a bubble-containing electrolytic solution is introduced from the electrode compartment into gas-liquid separation chambers 27,27.

The above-mentioned anode-side and cathode-side gas-liquid separation chambers 27,27 have gas and liquid outlet nozzles 8,8', respectively.

In the present invention, the basic structure of the unit cell having the above-mentioned gas-liquid separation chamber 27 (i.e., a structure of the unit cell shown in FIGS. 12 and 13, wherein FIGS. 12 and 13 are illustrated with omission of bubble removing partition wall 3 having apertured segment 2, baffle plate 21 and distributor 28) may be the same as those of the conventional unit cells. As an example of a conventional unit cell, there can be mentioned a unit cell described in the above-mentioned Unexamined Japanese Patent Application Laid-Open Specification No. 4-289184 (corresponding to U.S. Pat. No. 5,225,060). With respect to the above-mentioned Unexamined Japanese Patent Application Laid-Open Specification No. 4-289184 and the corresponding to U.S. Pat. No. 5,225,060), the contents thereof are incorporated herein by reference.

Further, with respect to the parts of the unit cell of the present invention other than bubble removing partition wall 3 having apertured segment 2, baffle plate 21 and distributor 28, such parts may be produced by using the materials and the methods, which are described in the above-mentioned Unexamined Japanese Patent Application Laid-Open Specification No. 4-289184 (corresponding to U.S. Pat. No. 5,225,060).

Hereinbelow, an explanation is made below with respect to the gas-liquid separation chamber of the unit cell of the present invention, referring to FIGS. 1 to 4.

FIGS. 1 to 4 are enlarged, diagrammatic cross-sectional views of various forms of the gas-liquid separation chamber of the unit cell of the present invention.

In the unit cell of the present invention, bubble removing partition wall 3 is disposed at least in anode-side gas-liquid separation chamber 27 of anode-side and cathode-side gas-liquid separation chambers 27,27, and extends upwardly of perforated bottom wall 4A of the gas-liquid separation chamber, wherein bubble removing partition wall 3 extends along the entire length of gas-liquid separation chamber 27 to partition gas-liquid separation chamber 27 into a first passage A formed on bottom wall 4A in a perforated area thereof and a second passage B formed on bottom wall 4A in a non-perforated area thereof.

More specifically, bubble removing partition wall 3 is disposed at least in anode-side gas-liquid separation chamber 27 of anode-side and cathode-side gas-liquid separation chambers 27,27, and extends upwardly of perforated bottom wall 4A of gas-liquid separation chamber 27, wherein perforated bottom wall 4A is locally perforated (that is, perforations 5 are locally present in bottom wall 4A) so that bottom wall 4A has a perforated area and a non-perforated area which are divided through bubble removing partition wall 3. Bubble removing partition wall 3 extends along the entire length of gas-liquid separation chamber 27 to partition gas-liquid separation chamber 27 into a first passage A formed on locally perforated bottom wall 4A in a perforated area thereof and a second passage B formed on locally perforated bottom wall 4A in a non-perforated area thereof.

Bubble removing partition wall 3 has apertured segment 2, wherein the apertures of apertured segment 2 of bubble removing partition wall 3 are positioned at least 10 mm above the inside surface of bottom wall 4A of gas-liquid separation chamber 27. The second passage B communicates with the gas and liquid outlet nozzle and communicates with the anode compartment through apertured segment 2 and the first passage A.

In the unit cell of the present invention, gas-liquid separation chamber 27 having bubble removing partition wall 3 disposed therein is adapted so that, during the operation of the unit cell, a bubble-containing liquid is introduced from the anode compartment into the first passage A of gas-liquid separation chamber 27 through the perforated area (having perforations 5) of locally perforated bottom wall 4A and allowed to pass through the apertures of apertured segment 2 of bubble removing partition wall 3, while maintaining the apertures of apertured segment 2 at a level above the liquid level of the second passage B, thereby breaking the bubbles of the bubble-containing liquid and allowing a gas generated by the breakage of the bubbles and a substantially bubble-free liquid to be introduced into the second passage B of gas-liquid separation chamber 27, wherein the gas and the substantially bubble-free liquid introduced into the second passage B are discharged therefrom through gas and liquid outlet nozzle 8 (shown in FIG. 12) of gas-liquid separation chamber 27.

The reason why such separation of the bubble-containing liquid into a gas and a liquid by the breakage of the bubbles becomes possible has not yet been elucidated, but is considered as follows. The bubble-containing electrolytic solution in the first passage A is introduced into the second passage B through the apertures of apertured segment 2 of bubble removing partition wall 3, together with a gas present in the upper portion of first passage A. At this time, the above-mentioned gas and the bubble-containing electrolytic solution get mixed with each other in the apertures to increase the size of the bubbles in the bubble-containing electrolytic solution, so that the bubbles in the bubble-containing electrolytic solution are easily broken. In the second passage B, apertured segment 2 of bubble removing partition wall 3 faces gaseous phase, so that the gas released from the bubble-containing electrolytic solution by the breakage of the bubbles is absorbed by the gaseous phase, whereas the electrolytic solution from which the bubbles have been removed is collected at the bottom of the second passage B. The separated gas and the gas-free electrolytic solution are withdrawn from gas-liquid separation chamber 27 through gas and liquid outlet nozzle 8, wherein the gas and the electrolytic solution are maintained to be separated from each other. Therefore, during the operation of the unit cell of the present invention, a vibration in the cell due to the pressure loss can be suppressed, so that a breakage of the ion exchange membrane can be prevented.

In FIG. 1, gas-liquid separation chamber 27 is composed of wall 1 , frame wall 25 , side wall 4B and bottom wall 4A. In the case of such a gas-liquid separation chamber, the cross-sectional area thereof is generally 10 to 100 $cm^2$ from the viewpoint of ease of and cost for production of the gas-liquid separation chamber 27. The electrolytic solution collected at the bottom of the second passage 4B is withdrawn from gas-liquid separation chamber 27 through gas and liquid outlet nozzle 8 (shown in FIG. 12), while maintaining the separation from the gas.

Figure 2:
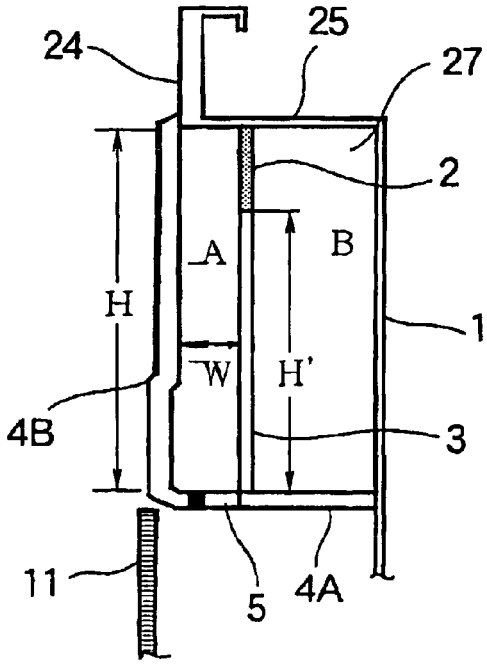
FIG. 2 is an enlarged, diagrammatic cross-sectional view of another form of a gas-liquid separation chamber of the unit cell of the present invention.
Figure 3:
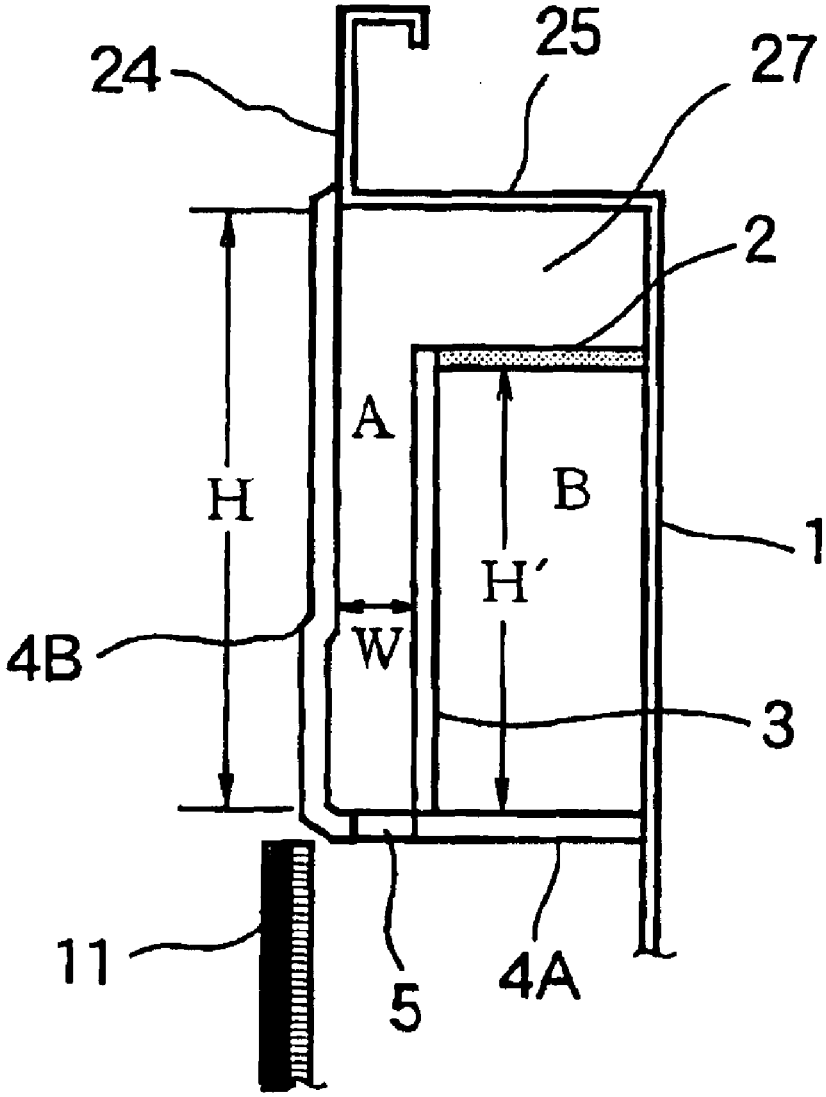
FIG. 3 is an enlarged, diagrammatic cross-sectional view of still another form of a gas-liquid separation chamber of the unit cell of the present invention.

In FIG. 1, the first passage A having perforations 5 of bottom wall 4A is formed on the side of wall 1. However, as shown in FIG. 2, the first passage A having perforations 5 of bottom wall 4A may be formed on the side of side wall 4B. With respect to bubble removing partition wall 3, a segment thereof other than apertured segment 2 (i.e., segment having no aperture, which is hereinafter, frequently referred to as "non-apertured segment") functions as a partition for separating the bubble-containing liquid in the first passage A from the bubble-removed liquid in the second passage B. Therefore, it is necessary that the position of apertures of apertured segment 2 be higher than the surface of the liquid in the second passage B. Specifically, the height (H') of the position of the apertures of apertured segment 2 from the inside surface of bottom wall 4A needs to be at least 10 mm. When bubble removing partition wall 3 is in the form of a plate as shown in FIGS. 1 and 2, needless to say, the height of the non-apertured segment of bubble removing partition wall 3 also needs to be at least 10 mm. Further, as shown in FIG. 3, when the height of the non-apertured segment of bubble removing partition wall 3 is relatively high, bubble removing partition wall 3 may have a structure wherein apertured segment 2 extends from the second passage B-side surface of the non-apertured segment. Also in such a case, the position of apertures of apertured segment 2 from the inside surface of bottom wall 4A needs to be higher than the surface of the liquid in the second passage B. Specifically, the height (H') of the position of the apertures of apertured segment 2 from the inside surface of bottom wall 4A needs to be at least 10 mm.

If the apertures of apertured segment 2 are present below the surface of the liquid in the second passage B, a disadvantage is caused wherein, even when the liquid containing a gas in the form of bubbles is passed through such apertures present below the surface of the liquid in the second passage B, the gas is not released into the gaseous phase but remains in the liquid, so that the liquid in the second passage B contains bubbles, which cause the pressure fluctuations at the outlet nozzle.

With respect to the height of the surface of the liquid in the second passage B, there is a tendency that the higher the current density employed for the electrolysis, the higher the surface of the liquid in the second passage B. For example, when the electrolysis is performed at a current density as high as 50 to 80 $A/dm^2$, the height of the surface of the liquid in the second passage B sometimes reaches 20 to 30 mm. Therefore, the height (H') of apertures of apertured segment 2 of bubble removing partition wall 3 is preferably 20 mm or more, more preferably 30 mm or more, most preferably 40 mm or more.

With respect to the height of non-apertured segment of bubble removing partition wall 3 , there is no particular limitation so long as the above-mentioned bubble removal can be efficiently conducted. For example, when bubble removing partition wall 3 having apertured segment 2 is in the form of a plate which extends substantially vertically from bottom wall 4A, it is preferred that the height of non-apertured segment is 90% or less of the height (H) of gas-liquid separation chamber 27. When the height of non-apertured segment exceeds 90 % of the height (H) of gas-liquid separation chamber 27, there is a danger that the pressure loss of the electrolytic solution introduced from the first passage A to the second passage B becomes large and a gas stagnates in the current flowing space in the unit cell, thereby adversely affecting the ion exchange membrane.

With respect to the width (W) of the first passage A, in FIG. 1, the width (W) is a distance between bubble removing partition wall 3 and wall 1; and, in each of FIGS. 2 to 4, the width (W) is a distance between side wall 4B and bubble removing partition wall 3. It is preferred that the width (W) is in the range of from 2 to 20 mm, because the pressure loss becomes small when the width (W) is in this range. Further, when the distance between side wall 4B and bubble removing partition wall 3 is not uniform as in the case of FIGS. 2 to 4, the shortest distance is defined as the width (W). When the width (W) exceeds 20 mm, the width of the second passage B becomes too small, so that the pressure loss becomes large. In such a case, there is a danger that the separated gas and the gas-free liquid are mixed again and the resultant gas-containing liquid causes the increase in pressure fluctuation at the outlet nozzle to cause the vibration in the unit cell. On the other hand, when the width (W) is less than 2 mm, there is a danger that the pressure loss of the bubble-containing liquid introduced from the first passage A to the second passage B becomes large and a gas stagnates in the current flowing space in the unit cell, thereby adversely affecting the ion exchange membrane.

Bubble removing partition wall 3 for removing bubbles may be formed either by a method in which apertures are formed in an upper portion of a single plate or a method in which an apertured plate is attached to a non-apertured plate. Further, bubble removing partition wall 3 may be integrally formed with bottom wall 4A of gas-liquid separation chamber 27 or may be attached to bottom wall 4A of gas-liquid separation chamber 27 by welding or the like. Bubble removing partition wall 3 integrally formed with bottom wall 4A can be obtained as follows. For example, when it is intended to produce parts of gas-liquid separation chamber by molding a resin, the molding is conducted by using a mold capable of forming a part having bottom wall 4A having integrally formed thereon partition wall 3. With respect to the materials used for producing bubble removing partition wall 3, there is no particular limitation so long as the materials have resistance to chlorine and sodium hydroxide. As examples of materials which can be used for producing bubble removing partition wall 3 disposed in anode-side gas-liquid separation chamber 27, there can be mentioned titanium and a titanium alloy. As examples of materials which can be used for producing bubble removing partition wall 3 disposed in cathode-side gas-liquid separation chamber 27, there can be mentioned iron, nickel and a stainless steel. Further, as materials for producing bubble removing partition wall 3, the materials other than mentioned above, such as plastics and ceramics, can be used, so long as such materials have resistance to chlorine and sodium hydroxide.

When an apertured plate made of the above-mentioned metal is attached to a non-apertured plate to obtain bubble removing partition wall 3, an expanded metal, a punched metal having circular apertures or square-shaped apertures, a wire net, a wire mesh, a foam metal or the like can be used as the apertured plate.

Further, when an apertured plate is attached to a non-apertured plate to obtain bubble removing partition wall 3, there is no limitation with respect to the manners for attaching the apertured plate to the non-apertured plate. For example, an apertured plate may be attached to a non-apertured plate in any of the following manners:

(1) a manner in which an apertured plate is substantially vertically attached to the top portion of a non-apertured plate, which is also substantially vertically formed on bottom wall 4A, to thereby obtain plate-shaped bubble removing partition wall 3 as shown in FIGS. 1 and 2;

(2) a manner in which an apertured plate is attached to a non-apertured plate (which is substantially vertically formed on bottom wall 4A) at an upper end portion of the lateral surface thereof facing the second passage B, wherein the apertured plate extends substantially horizontally to obtain partition wall 3 having a ⌈-shaped cross section as shown in FIG. 3 or extends with a slightly upward or downward gradient relative to the direction perpendicular to the lateral surface of the non-apertured plate; and (3) a manner in which an apertured plate is attached to a non-apertured plate (which is substantially vertically formed on bottom wall 4A) at a middle portion of the lateral surface thereof facing the second passage B, wherein the apertured plate extends substantially horizontally to obtain partition wall 3 having a ⊢-shaped cross-section as shown in FIG. 4 or extends with a slightly upward or downward gradient relative to the direction perpendicular to the side wall of the non-apertured plate.

In either of the above-exemplified manners, the apertured plate should be secured to the non-apertured plate so as to prevent the apertured plate from being detached from the non-apertured plate during the operation of the unit cell. For this purpose, for example, when both of the non-apertured plate and the apertured plate are made of a metal, it is preferred to attach the apertured plate to the non-apertured plate by welding.

Further, bubble removing partition wall 3 may be one obtained by forming apertured segment 2 in a middle portion of a non-apertured plate. As an example of such bubble removing partition wall 3, there can be mentioned a metal plate having apertures formed in a middle portion thereof.

With respect to apertured segment 2 of bubble removing partition wall 3 , it is preferred that the aperture ratio of apertured segment 2 is preferably in the range of from 10 to 80%, based on the area of apertured segment 2. Further, from the viewpoint of pressure loss reduction and bubble removal efficiency, it is most preferred that the aperture ratio is in the range of from 30 to 70%. With respect to the aperture ratio of bubble removing partition wall 3, it is preferred that the aperture ratio is,in the range of from 4 to 60%, based on the area of bubble removing partition wall 3. With respect to the size of apertures of apertured segment 2 , there is no particular limitation. However, when the size of apertures of apertured segment 2 is too large, there is a danger that, when the bubble-containing electrolytic solution in the first passage A is passed through apertured segment 2 and introduced into the second passage B, the bubbles in the electrolytic solution are not broken, so that an electrolytic solution which still contains bubbles is collected in the second passage B. Therefore, the area of each aperture of the apertured segment 2 is preferably 150 $mm^2$ or less, more preferably 80 $mm^2$ or less. The average area of apertures of apertured segment 2 is preferably in the range of from 0.2 to 80 $mm^2$ more preferably 3 to 60 $mm^2$. The number of apertures is appropriately selected depending on the above-mentioned aperture ratio and average area of apertures.

With respect to the distribution of apertures in apertured segment 2 , there is no particular limitation so long as the bubble removal can be conducted efficiently. However, it is preferred that the distribution of apertures is as uniform as possible. As specific examples of manners of forming apertures, there can be mentioned a manner in which nineteen (19) circular apertures, each having a diameter of 2 mm, are formed at a pitch of 3 mm, per 1 $cm^2$ of apertured segment 2 , and a manner in which thirty five (35) rhombic apertures, each having diagonal lines of 7 mm and 4 mm, are formed, per 10 $cm^2$ of apertured segment 2.

Apertured segment 2 may also be formed by combining two plates which are different in the aperture ratio.

With respect to the thickness of bubble removing partition wall 3, there is no particular limitation so long as the strength of partition wall 3 is satisfactory and the bubble removal can be conducted without increasing the pressure loss. Specifically, it is preferred that the thickness of bubble removing partition wall 3 is in the range of from 0.1 to 5 mm.

With respect to the angle between bubble removing partition wall 3 and bottom wall 4A, there is no particular limitation so long as the bubble-containing electrolytic solution in the first passage A can be introduced into the gaseous phase in the second passage B through apertures of apertured segment 2. The non-apertured segment and the apertured segment 2 may have different angles to bottom wall 4A. Specifically, for example, as shown in FIGS. 1 and 2, apertured segment 2 may extend substantially vertically from the top portion of the non-apertured segment, which is also substantially vertically provided in gas-liquid separation chamber 27. Alternatively, as shown in FIG. 3, apertured segment 2 may extend substantially horizontally, or may extend with a slightly upward or downward gradient relative to the horizontal direction, from the upper end portion of the surface of the non-apertured segment, which surface faces the second passage B. However, as mentioned above, the apertures of apertured segment 2 need to be maintained above the surface of the liquid in the second passage B.

Further, bubble removing partition wall 3 may have a plurality of apertured segment 2. For example, bubble removing partition wall 3 may have not only apertured segment 2 , which extends substantially vertically from the top portion of the non-apertured segment as shown in FIGS. 1 and 2, but also apertured segment 2 , which extends substantially horizontally from the upper end portion of the surface of the non-apertured segment on the side of the second passage B.

With respect to the above-mentioned apertured segment 2, one end thereof needs to be in contact with the above-mentioned non-apertured segment; however, it is not necessary for the other end of apertured segment 2 to be in contact with the inner wall of the gas-liquid separation chamber. For example, in the case of substantially vertical apertured segment 2 as shown in FIGS. 1 and 2, it is preferred that the height of apertured segment 2 is ½ or more of the difference between the height (H) of the gas-liquid separation chamber and the height (H') of the non-apertured segment. From the viewpoint of efficiently conducting the bubble removal even when the electrolysis is performed at a high current density, it is preferred that the height of apertured segment 2 is as large as possible. Further, from the viewpoint of easiness in production of the unit cell, it is preferred that the height of apertured segment 2 is the same as the difference between the above-mentioned height (H) and height (H') (that is, apertured segment 2 extends from the top portion of the non-apertured segment to the inside surface of upper frame wall 25 of the gas-liquid separation chamber as shown in FIGS. 1 and 2. Also in the case of substantially horizontal apertured segment 2 as shown in FIGS. 3 and 4, it is preferred that, as shown in FIGS. 3 and 4, the apertured segment 2 extends to reach the inner side wall (wall 1) of gas-liquid separation chamber 27, so that bubble removing partition wall 3 completely separates the second passage B from the first passage A. In the case of substantially horizontal apertured segment 2, if bubble removing partition wall 3 does not completely separates the second passage B from the first passage A, a disadvantage is likely to occur wherein the bubble-containing liquid flows from the first passage A to the second passage B through a gap between apertured segment 2 and the inner wall of gas-liquid separation chamber 27, so that the bubble removal cannot be efficiently achieved.

As apparent from the above, bubble removing partition wall 3 may be in various forms and may have various sizes, so long as the bubble-containing electrolytic solution in the first passage A can be introduced into the gaseous phase in the second passage B through the apertures of apertured segment 2. However, from the viewpoint of easiness in production of the unit cell and efficiency in the bubble removal, it is preferred that bubble removing partition wall 3 has any one of the following structures:

(1) a plate-shaped structure in which, as shown in FIGS. 1 and 2, bubble removing partition wall 3 having apertured segment 2 extends upwardly and substantially vertically from bottom wall 4A, wherein the height of bubble removing partition wall 3 is the same as the height (H) of gas-liquid separation chamber 27, (2) a reversed L-shaped structure in which, as shown in FIG. 3, the non-apertured segment extends upwardly and substantially vertically from bottom wall 4A and apertured segment 2 extends substantially horizontally from the upper end portion of the non-apertured segment to the inside surface of wall 1, and (3) a ⊢-shaped structure in which, as shown in FIG. 4, the non-apertured segment extends upwardly and substantially vertically from bottom wall 4A and apertured segment 2 extends substantially horizontally from the middle portion of the non-apertured segment to the inside surface of wall 1.

If gas-liquid separation chamber 27 has only a porous plate horizontally extending therein as shown in FIG. 5, instead of bubble removing partition wall 3, almost no effect of removing bubbles can be achieved (see Comparative Example 1 described below).

With respect to the size of perforation 5 of bottom wall 4A, through which a gas, an electrolytic solution and bubbles are introduced into gas-liquid separation chamber 27, for example, in the case of FIGS. 1 and 2, it is desirable that the size does not exceed the above-mentioned width (W). The shape of perforation 5 is not particularly limited and may be, for example, circular, elliptic, square, rectangular or rhombic. The perforation ratio of bottom wall 4A is preferably in the range of from 10 to 80%, based on the area of the bottom wall of the first passage A (i.e., width (W) of the first passage A ×length of the gas-liquid separation chamber). When the perforation ratio is less than 10%, a pressure loss may occur at the time a gas and a liquid pass through perforations 5 into gas-liquid separation chamber 27, so that the gas is likely to stagnate in the upper portion of the electrode compartment, forming a gas zone. The thus formed gas zone is likely to have an adverse effect on the ion exchange membrane. On the other hand, when the perforation ratio exceeds 80%, a disadvantage is likely to occur wherein the strength of gas-liquid separation chamber 27 becomes disadvantageously low, so that gas-liquid separation chamber 27 suffers distortion when an electrolytic cell is assembled by combining and fastening a plurality of unit cells through electrodes and gaskets.

In the unit cell of the present invention, the above-mentioned bubble removing partition wall 3 is disposed at least in anode-side gas-liquid separation chamber 27 of anode-side and cathode-side gas-liquid separation chambers 27, 27. Especially, in anode-side gas-liquid separation chamber 27, the bubbles contained in the electrolytic solution have a great influence and, hence, a satisfactory effect of removing bubbles can be achieved even when bubble removing partition wall 3 is disposed only in anode-side gas-liquid separation chamber 27 .

Side wall 4B of gas-liquid separation chamber 27 may have flat surfaces, but is preferred to have a configuration as shown in FIGS. 1 to 4 in which a lower portion of side wall 4B protrudes outwardly. By the presence of such lower protruded portion of side wall 4B, the tightness of contact between gas-liquid separation chamber 27 and gaskets 16, 18 shown in FIG. 14 can be increased. Further, when the width of each of gaskets 16,18 is uniform, the pressures sustained by the gasket at different surface portions thereof during the assembling of the electrolytic cell become uniform.

Figure 6:
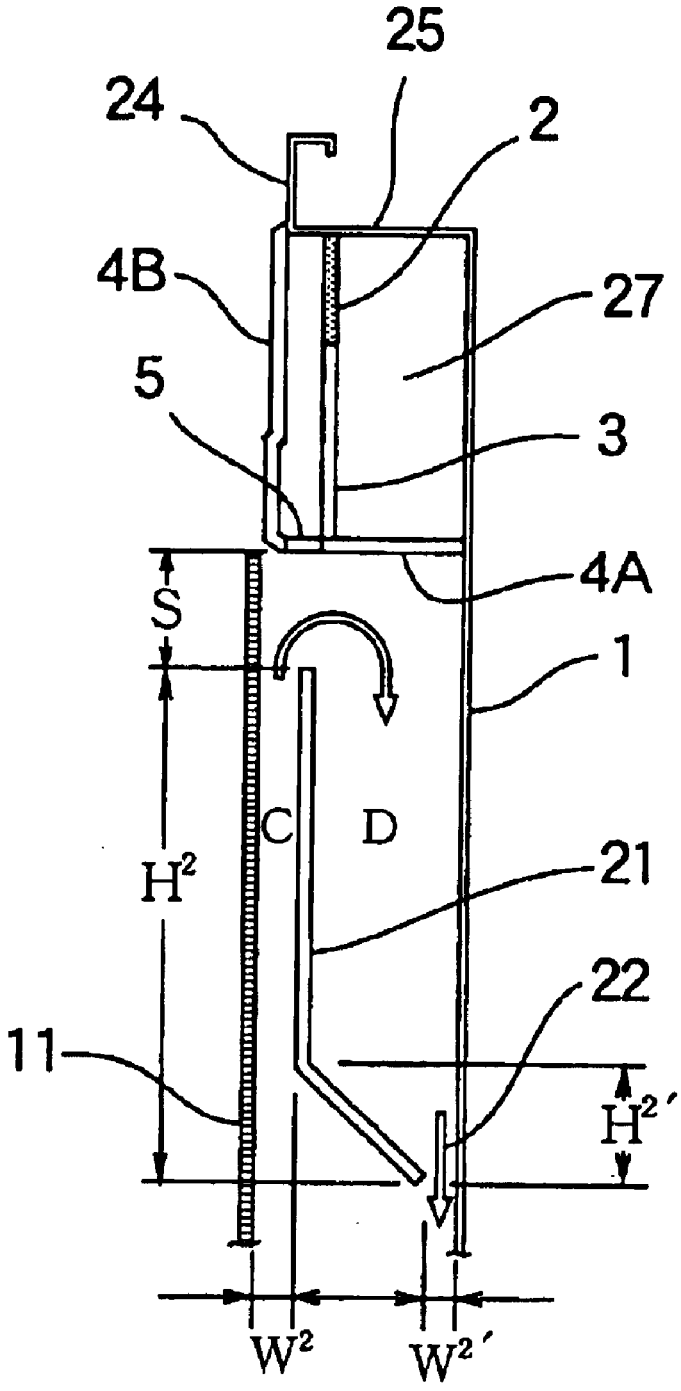
FIG. 6 is an enlarged, diagrammatic cross-sectional view of an upper portion of an electrode compartment of one embodiment of the unit cell of the present invention, which has a baffle plate disposed therein, together with a gas-liquid separation chamber disposed above the electrode compartment.
Figure 7:
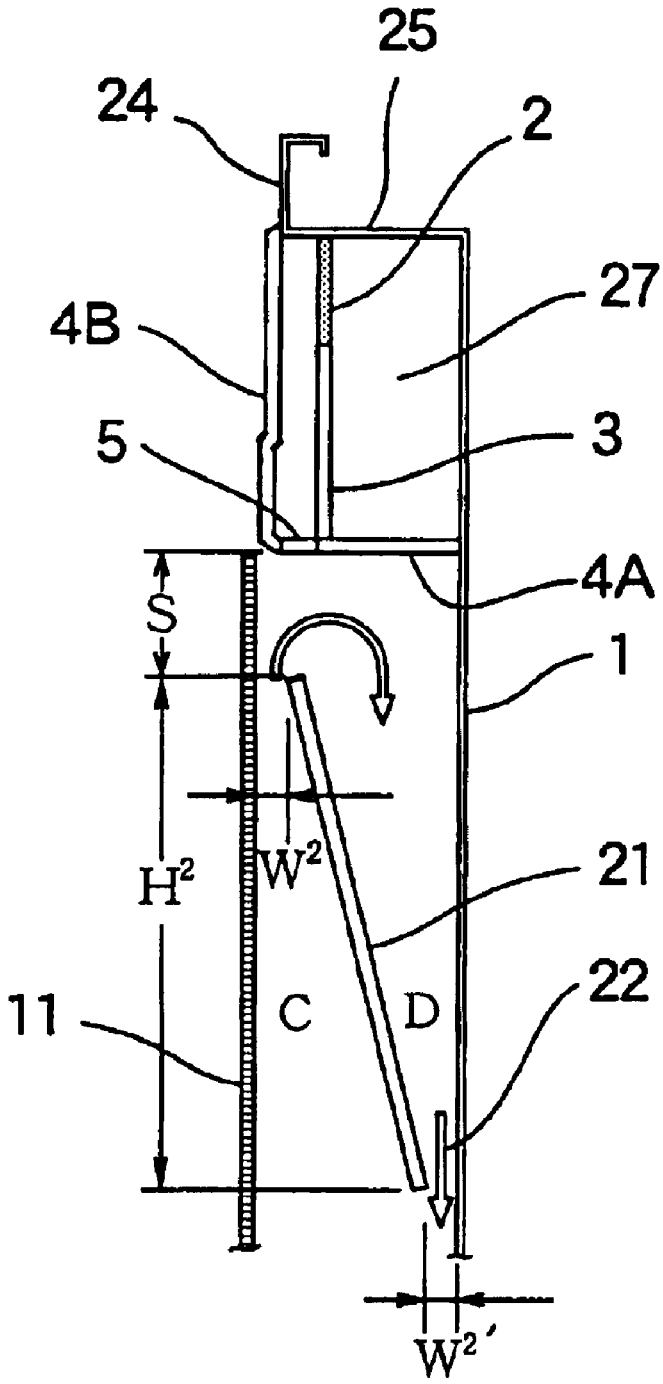
FIG. 7 is an enlarged, diagrammatic cross-sectional view of an upper portion of an electrode compartment of another embodiment of the unit cell of the present invention, which has a baffle plate disposed therein, together with a gas-liquid separation chamber disposed above the electrode compartment.
Figure 8:
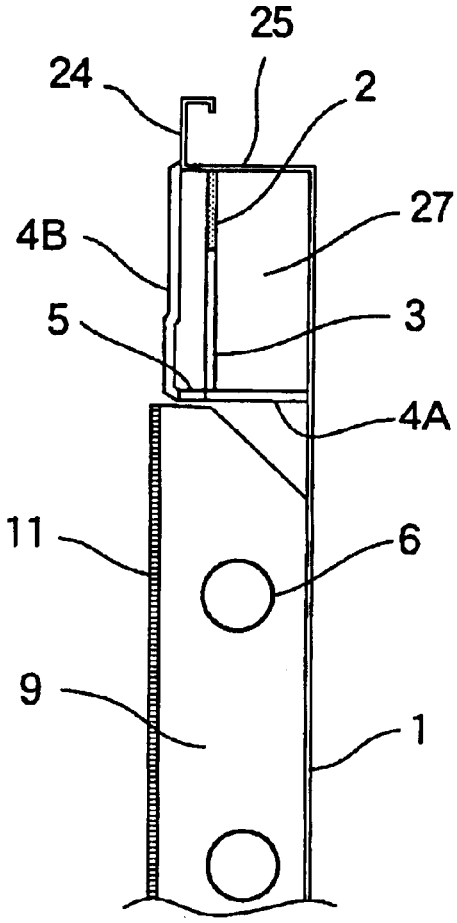
FIG. 8 is an enlarged, diagrammatic cross-sectional view of an upper portion of an electrode compartment of still another embodiment of the unit cell of the present invention, which does not have a baffle plate, together with a gas-liquid separation chamber disposed above the electrode compartment.

In the present invention, it is preferred that, as shown in FIGS. 6 and 7, the unit cell further comprises, at least in the anode compartment of the anode and cathode compartments, baffle plate 21 disposed in an upper portion of the anode compartment, wherein baffle plate 21 is positioned so that an upward flow passage C is formed between baffle plate 21 and anode 11 and a downward flow passage D is formed between baffle plate 21 and a back-side inner wall (inside surface of wall 1) of the anode compartment.

For example, when baffle plate 21 is disposed in an upper portion of the anode compartment, it becomes possible not only to flow the electrolytic solution back to a lower portion of the unit cell to thereby circulate the electrolytic solution in the anode compartment, but also to efficiently introduce the electrolytic solution into gas-liquid separation chamber 27 without causing stagnation of a gas in the upper portion of the anode compartment.

Further, when baffle plate 21 is disposed in an upper portion of the anode compartment, a slit-like gap 22 is formed between the lower end portion of baffle plate 21 and wall 1. In this instance, the electrolytic solution, which has flowed over the top of baffle plate 22 and been introduced into the downward flow passage D, returns to the lower portion of the anode compartment through slit-like gap 22 and, then, to the upper portion of the anode compartment through upward flow passage C, so that the electrolytic solution circulates in the anode compartment.

With respect to the upward flow passage C formed between baffle plate 21 and anode 11 a mixture of the electrolytic solution, the bubbles and the gas passes therethrough. A mixture of the electrolytic solution, and the gas and bubbles which are formed by electrolysis passes through a gap between the top portion of baffle plate 21 and the top wall of the electrode compartment, wherein a part of the electrolytic solution and a part of the gas enter gas-liquid separation chamber 27, and the remainder of the electrolytic solution and the remainder of the gas flow down along the downward flow passage D and, then, return to the lower portion of the electrode compartment through slit-like gap 22.

Thus, by virtue of baffle plate 21, it becomes possible to circulate the electrolytic solution inside the electrode compartment, so that the stagnation of the electrolytic solution and the gas can be prevented and the uniform concentration distribution of the electrolytic solution can be achieved in the electrode compartment even when the electrolysis is performed at a current density as high as 50 $A/dm^2$ or more.

With respect to baffle plate 21, the thickness thereof is preferably in the range of from 0.5 to 1.5 mm, and the length thereof is preferably in the range of from 300 to 700 mm. It is preferred that the width of baffle plate 21 is as close to the width of the unit cell as possible, and it is most preferred that the width of baffle plate 21 is the same as the width of the unit cell as shown in FIG. 12. As examples of materials for baffle plate 21 used in the anode compartment, there can be mentioned materials, such as titanium and resins (e.g., Teflon), which have resistance to corrosion by chloride. As examples of materials for baffle plate 21 used in the cathode compartment, there can be mentioned materials, such as a stainless steel and nickel, which have resistance to corrosion by alkali.

With respect to the method for setting baffle plate 21 in the electrode compartment, there is no particular limitation. As examples of such methods, there can be mentioned a method in which baffle plate 21 having the same width as the interval of ribs 9 is fixed onto ribs 9 by welding or the like, and a method in which, using ribs 9 having a groove for receiving therein an edge portion of baffle plate 21, baffle plate 21 is attached to ribs 9 by inserting an edge portion of baffle plate 21 into the groove of ribs 9.

With respect to the cross-sectional area of the downward flow passage D, from the viewpoint of ease of and cost for production of the unit cell, the cross-sectional area is generally in the range of from 10 $cm^2$ to 200 $cm^2$. Baffle plate 21 also has a function to separate the bubble-containing electrolytic solution in the upward flow passage C from the electrolytic solution in the downward flow passage D, so that the electrolytic solution can flow upwardly in the passage C and can be introduced into gas-liquid separation chamber 27 by the ascension power,of the gas entrapped in the electrolytic solution in the form of bubbles. The height (H) of baffle plate 21 is preferably in the range of from 300 to 700 mm. The reason for this is as follows. For increasing the amount of the liquid circulating in the electrode compartment, it is necessary to increase the difference in composition between the liquid around the top of the upward flow passage C and the liquid around the top of the downward flow passage D. For this purpose, it is advantageous that the height of baffle plate 21 is large.

The gap S between the top of the baffle plate and the top wall of the electrode compartment is preferably in the range of from 5 to 200 mm. When this gap S is too narrow, a gas is likely to stagnate at an upper portion of the electrode compartment. On the other hand, when the gap S is too broad, the electrolytic solution at the upper portion of the electrode compartment cannot be satisfactorily stirred, so that the ion exchange membrane is adversely affected.

When the width of the upward flow passage C is defined as the distance (W2) between baffle plate 21 and electrode 11, for advantageously suppressing the pressure loss, it is preferred that the width (W2) is in the range of from 5 to 15 mm. When the width (W2) exceeds 15 mm, it is likely that the upward flow rate of the electrolytic solution in the upward flow passage C becomes low, so that the efficient stirring of the electrolytic solution tends to become difficult, thereby causing problems, such as local lowering of the concentration of the electrolytic solution. On the other hand, when the width (W2) is smaller than 5 mm, it is likely that a large pressure loss is caused by the flow of a gas and a liquid in the upward flow passage C, so that the amount of the electrolytic solution passing through the upward flow passage C is decreased.

With respect to the width (W2') of the slit-like gap between the lower end portion of baffle plate 21 and the inside surface of wall 1, the width (W2') is preferably in the range of from 1 to 20 mm, more preferably 1 to 10 mm. When the width (W2') is less than 1 mm, a disadvantage is like to occur wherein the pressure loss of the electrolytic solution passing through the above-mentioned slit-like gap becomes large, so that the circulation of the electrolytic solution becomes stagnant at the downward flow passage D. On the other hand, when the width (W2') exceeds 20 mm, a disadvantage is like to occur wherein the electrolytic solution and the gas which have been introduced into the electrode compartment directly flow into not only the upward flow passage D, but also the downward flow passage D through the slit-like gap, so that the circulation of the electrolytic solution does not occur in the electrode compartment.

With respect to the shape of cross-section of baffle plate 21, various shapes may be employed. For example, it is possible to employ a bent plate-shaped baffle plate as shown in FIG. 6, and a flat plate-shaped baffle plate as shown in FIG. 7. When baffle plate 21 has an uneven surface, there is a danger that the upward flow rates of the gas and the liquid are affected, so that, for example, the concentration distribution of the electrolytic solution in the anode compartment becomes non-uniform. Therefore, it is preferred that baffle plate 21 has a flat surface.

Thus, by providing baffle plate 21 in the electrode compartment, it becomes possible not only to stir the bubble-rich electrolytic solution at an upper portion of the electrode compartment, but also to circulate the electrolytic solution in the electrode compartment. Therefore, even when the electrolysis is performed at a current density as high as 50 $A/dm^2$ or more, not only can the concentration distribution of the electrolytic solution in the electrode compartment be kept uniform, but also no adverse effects on the ion exchange membrane occur.

If desired, the unit cell of the present invention may further comprise an electrolytic solution distributor. An example of the electrolytic solution distributor is shown in FIGS. 12 and 13, wherein the distributor is designated by numeral 28.

Figure 9:
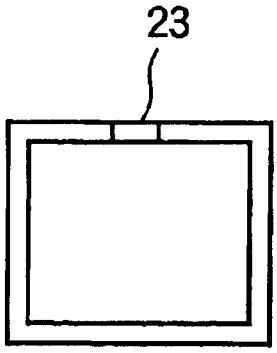
FIG. 9 is a diagrammatic cross-sectional view of one form of an electrolytic solution distributor.
Figure 10:
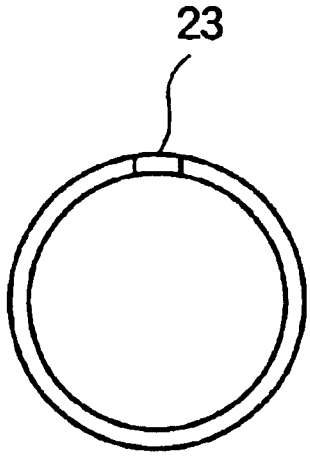
FIG. 10 is a diagrammatic cross-sectional view of another form of an electrolytic solution distributor.
Figure 11:
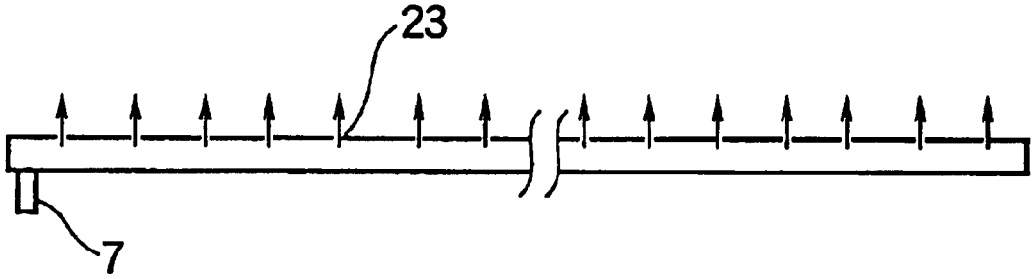
FIG. 11 is a diagrammatic side view of still another form of an electrolytic solution distributor (in which the arrows indicate an electrolytic solution flowing out of the distributor through holes 23)

FIG. 9 is a diagrammatic cross-sectional view of one form of an electrolytic solution distributor. FIG. 10 is a diagrammatic cross-sectional view of another form of an electrolytic solution distributor. FIG. 11 is a diagrammatic side view of still another form of an electrolytic solution distributor (in which the arrows indicate an electrolytic solution flowing out of the distributor through holes 23). By the use of the electrolytic solution distributor, it becomes possible to render uniform the concentration distribution of the electrolytic solution along lines extending in the horizontal, longitudinal direction (in the lateral direction in FIG. 12).

That is, in a preferred embodiment of the present invention, the unit cell of the present invention further comprises, at least in the anode compartment of the anode and cathode compartments, an electrolytic solution distributor having a pipe-like morphology and disposed in a lower portion of the anode compartment, the distributor having a plurality of electrolytic solution feed holes and having an inlet communicating with an electrolytic solution inlet nozzle of the anode compartment, wherein each of the electrolytic solution feed holes has a cross-sectional area such that, during the operation of the unit cell, when a saturated saline solution is supplied as an electrolytic solution through the distributor at a minimum flow rate for conducting an electrolysis at a current density of 40 $A/dm^2$, each electrolytic solution feed hole exhibits a pressure loss of from 50 $mm \cdot H_2O$ to 1,000 $mm \cdot H_2O$.

The shape of the cross-section of the electrolytic solution distributor is not limited, and may be either circular or square. With respect to the electrolytic solution feed holes 23 through which the electrolytic solution in the distributor flows out, from the viewpoint of securing a uniform feeding along lines extending in the horizontal, longitudinal direction in the electrode compartment, it is preferred that the number of the electrolytic solution feed holes 23 is as large as possible. However, when the number of electrolytic solution feed holes 23 is too large, the production process for the distributor becomes difficult. Therefore, the number of electrolytic solution feed holes 23 is appropriately 10 to 50, preferably 15 to 40.

For uniformly feeding the electrolytic solution into the electrode compartment from the electrolytic solution distributor, it is preferred that each electrolytic solution feed holes 23 exhibits a pressure loss exceeding a specific level. According to the experiments conducted by the present inventors, when the electrolysis is performed at a current density of 40 $A/dm^2$ under conditions wherein each electrolytic solution feed hole exhibits a pressure loss of less than 50 $mm \cdot H_2O$, the electrolytic solution cannot be uniformly fed into the electrode compartment. Therefore, the present inventors made studies on the cross-sectional area of electrolytic solution feed holes 23 which enables a uniform feeding of the electrolytic solution into the electrode compartment. As a result, they have found that such a uniform feeding can be achieved when each of the electrolytic solution feed holes has a cross-sectional area such that, during the operation of the unit cell, when a saturated saline solution is supplied as an electrolytic solution through the distributor at a minimum flow rate for conducting an electrolysis at a current density of 40 $A/dm^2$, each electrolytic solution feed hole exhibits a pressure loss of from 50 $mm \cdot H_2O$ to 1,000 $mm \cdot H_2O$. Further, it has also been found that, when each electrolytic solution feed hole exhibits a pressure loss exceeding 1,000 $mm \cdot H_2O$ in an electrolysis performed under the above-mentioned conditions, the cross-sectional area of each feed holes 23 is too small and, hence, a disadvantage is likely to occur wherein the feed holes are clogged with fine particles of impurities and the like, so that a uniform feeding of the electrolytic solution cannot be achieved. From the practical viewpoint, the most preferred pressure loss is in the range of from 100 $mm \cdot H_2O$ to 600 $mm \cdot H_2O$.

The shape of the cross-section of each electrolytic solution feed holes 23 of the electrolytic solution distributor is not limited, but is preferred to be circular or square, from the viewpoint of ease of production of the distributor. The appropriate cross-sectional area of feed holes 23 varies depending on the pressure loss, the number of feed holes 23, the feeding rate of the electrolytic solution and the like. However, generally, it is preferred that the cross-sectional area of each feed holes 23 is in the range of from 10 mm to 1 mm.

With respect to the cross-sectional area of the hollow portion of the electrolytic solution distributor, there is no particular limitation. However, generally, it is preferred that the cross-sectional area is in the range of from 1 to 20 $cm^2$. The length of the electrolytic solution distributor is not limited, so long as the distributor can be accommodated in the electrode compartment. However, generally, the length of the electrolytic solution distributor is in the range of from 70 to 100% of the horizontal, longitudinal length of the electrode compartment of the unit cell. As examples of materials used for the electrolytic solution distributor used in the anode compartment, there can be mentioned materials having resistance to corrosion by chlorine, such as titanium and teflon. As examples of materials used for the electrolytic solution distributor used in the cathode compartment, there can be mentioned materials having resistance to corrosion by an alkali, such as nickel and a stainless steel.

In the embodiment of the unit cell of the present invention which is shown in FIG. 12 and FIG. 13 (FIG. 13 is a diagrammatic cross-sectional view of the unit cell of FIG. 12, taken along line II—II of FIG. 12), baffle plate 21 and electrolytic solution distributor 28 are provided in the electrode compartment.

In the embodiment of the unit cell of the present invention which is shown in FIG. 13, gas-liquid separation chamber 27 thereof has bubble removing partition wall 3, which extends upwardly of perforated bottom wall 4A and which has apertured segment 2.

Figure 14:
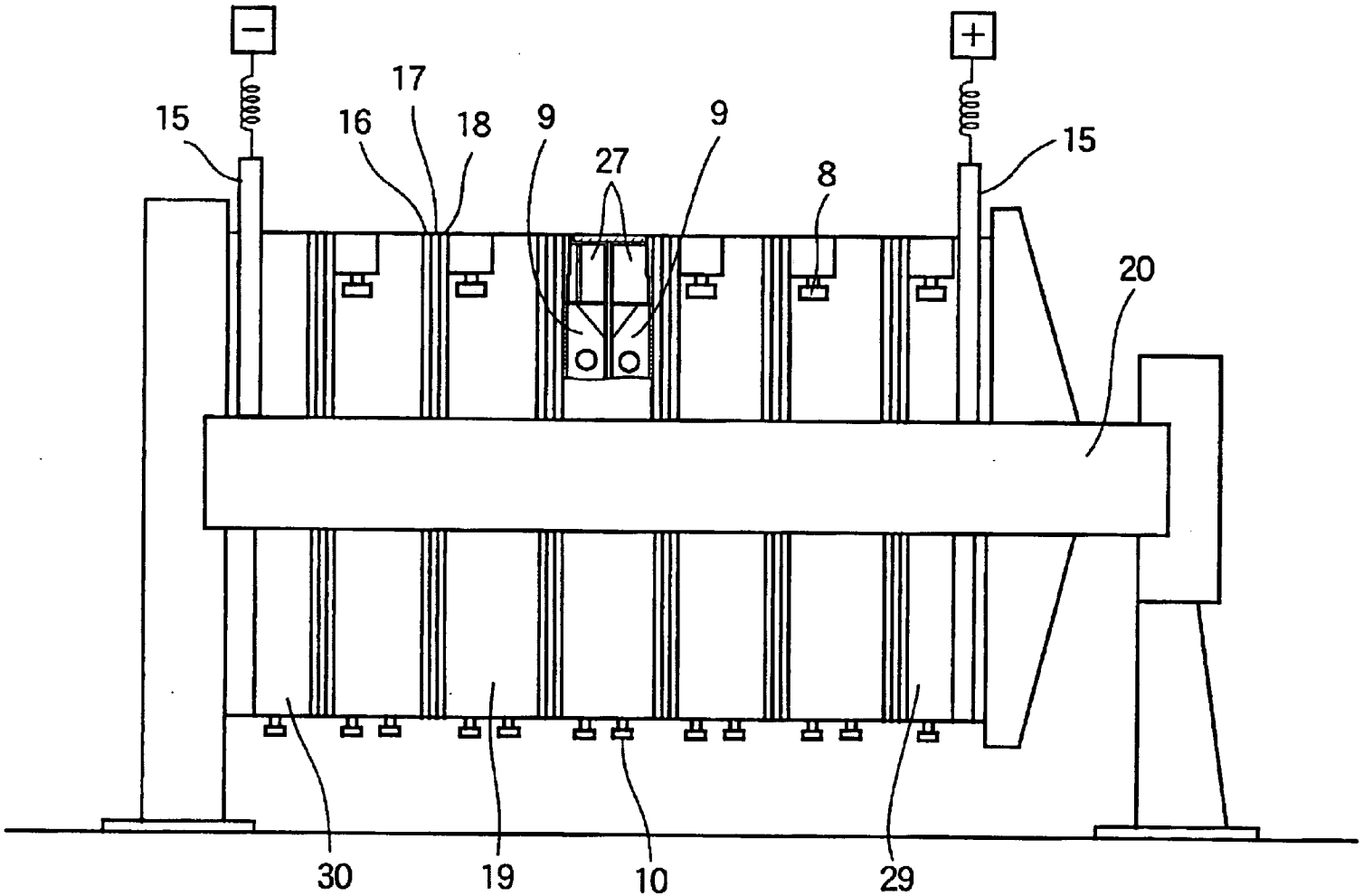
FIG. 14 is a diagrammatic side view of one embodiment of the bipolar, filter press type electrolytic cell, which has been constructed by arranging a plurality of unit cells of the present invention in series through a cation exchange membrane disposed between respective adjacent unit cells, shown with a partly broken frame wall of one unit cell in order to show the interior of the unit cell.

FIG. 14 is a diagrammatic side view of one embodiment of the bipolar, filter press type electrolytic cell, which has been constructed by arranging a plurality of unit cells 19 the present invention in series through cation exchange membrane 17 disposed between respective adjacent unit cells, shown with a partly broken frame wall of one unit cell in order to show the interior of the unit cell. In the embodiment shown in FIG. 14, five (5) unit cells 19 are arranged in series through anode-side gasket 18, cation exchange membrane 17 and cathode-side gasket 16 which are disposed between respective adjacent unit cells, and monopolar cells (anode cell 29 and cathode cell 30) are, respectively, disposed at both sides of the serially arranged five unit cells 19, to thereby form a stack. The stack is fastened by means of fastening frame 20. Two current lead plates 15,15 respectively carried by the two monopolar cells are disposed on both sides of the stack. Voltage is adapted to be applied to the unit cells through current lead plates 15,15.

The unit cell of the present invention can be very advantageously used in a bipolar, filter press type electrolytic cell in that, even when the electrolysis is performed at a current density as high as, for example, 50 A/dm$^2$ or more, a gas and an electrolytic solution can be discharged in a condition wherein the gas and the electrolytic solution are substantially completely separated from each other, so that the occurrence of vibrations in the cell can be greatly suppressed, thereby preventing the occurrence of the adverse effects of vibrations, such as the occurrence of a breakage of an ion exchange membrane. Therefore, the unit cell of the present invention is commercially very advantageous.

BEST MODE FOR CARRYING OUT THE INVENTION

Hereinbelow, the present invention will be described in more detail with reference to Examples and Comparative Examples, which should not be construed as limiting the scope of the present invention.

EXAMPLE 1

A bipolar filter press type electrolytic cell as shown in FIG. 14 was assembled, as described below. Eight bipolar electrolytic unit cells 19 were provided, each of which has gas-liquid separation chambers as shown in FIG. 2, baffle plate 21 as shown in FIG. 7, electrolytic solution distributor 28 as shown in FIGS. 9 and 11 and each of which has a frontal shape as shown in FIG. 12 and a cross-section as shown in FIG. 13. The 8 unit cells 19 were arranged in series through cathode-side gasket 16, ion exchange membrane 17 and anode-side gasket 18 which were disposed between respective adjacent unit cells to thereby form a bipolar-unit cell stack, and anode unit cell 29 and cathode unit cell 30 were, respectively, disposed on both sides of the bipolar-unit-cell stack through a cathode-side gasket, an ion exchange membrane and an anode-side gasket to thereby form a final stack. Two current lead plates 15, 15 were disposed on both sides of the final stack.

Each of unit cells 19 has a width of 2,400 mm and a height of 1,280 mm. The anode compartment of the unit cell has an inside thickness of 34 mm (wherein the inside thickness means the distance between the inside surface of the anode and the back-side inner wall (inside surface of wall 1) of the anode compartment). The cathode compartment of the unit cell has an inside thickness of 22 mm (wherein the inside thickness means the distance between the inside surface of the cathode and the back-side inner wall (inside surface of wall 1) of the cathode compartment). The unit cell has a current flowing area of 2.7 m$^2$. Anode-side gas-liquid separation chamber 27 has a length of 2,362 mm, a height (H) of 86 mm, a width of 30 mm, a cross-sectional area of 25.8 cm$^2$. Cathode-side gas-liquid separation chamber 27 has a length of 2,362 mm, a height of 86 mm, a width of 18 mm, a cross-sectional area of 15.48 cm$^2$. Of the anode-side and cathode-side gas-liquid separation chambers, only anode-side gas-liquid separation chamber 27 has a structure as shown in FIG. 2. Anode-side gas-liquid separation chamber 27 having such structure was produced in the following manner. First, a titanium plate (having no aperture) having a length which was the same as the entire length of the gas-liquid separation chamber, a height (H') of 50 mm and a thickness of 1 mm was provided, and a longitudinal edge of the titanium plate was fixed by welding to perforated bottom wall 4A (having localized perforation 5) of anode-side gas-liquid separation chamber 27 along the entire length of the gas-liquid separation chamber so that the width (W) of a first passage A would become 5 mm. Then, there was provided titanium expanded metal 2 having an opening area ratio of about 49% and a thickness of 1 mm (wherein titanium expanded metal 2 was a perforated plate having rhombic openings at a density of 35 openings relative to 10 cm$^2$, wherein each opening had a vertical diagonal length of 4 mm and a horizontal diagonal length of 7 mm). Titanium expanded metal 2 was vertically fixed by welding to the upper edge of the above-mentioned titanium plate (fixed to perforated bottom wall 4A) so that titanium expanded metal 2 vertically extended from the upper edge of the titanium plate to the upper end of anode-side gas-liquid separation chamber 27 along the entire length of the gas-liquid separation chamber. Thus, by using bubble removing partition wall 3 (comprising the titanium plate and perforated plate 2), anode-side gas-liquid separation chamber 27 was partitioned into a first passage A formed on bottom wall 4A in a perforated area thereof (having localized perforation age B formed on bottom wall 4A in a non-perforated Perforation 5 of perforated bottom wall 4A of anode-side gas-liquid separation chamber 27 was formed by a method in which elliptic holes each having a minor diameter of 5 mm and a major diameter of 22 mm are formed at a pitch of 37.5 mm. Perforated bottom wall 4A of anode-side gas-liquid separation chamber 27 has an opening area ratio of 56%, based on the bottom area of the first passage A (which is expressed by the formula: "width (W) of first passage A×length of gas-liquid separation chamber").

Perforation 5 of perforated bottom wall 4A of cathode-side gas-liquid separation chamber 27 was formed by a method in which circular holes each having a diameter of 10 mm are formed at a pitch of 20 mm.

Baffle plate 21 employed is a titanium plate having a cross-section as shown in FIG. 7 and a thickness of 1 mm. Baffle plate 21 was disposed only in the anode compartment. Baffle plate 21 has a height ($H^2$) of 500 mm. Baffle plate 21 was positioned so that an upward flow passage C was formed between baffle plate 21 and anode 11 and a downward flow passage D was formed (inside surface of wall 1) of the anode compartment, wherein the upward flow passage C had a width ($W^2$) of 10 mm at an upper end thereof and the downward flow passage D had a width ($W^2$) of 3 mm at a lower end thereof. The distance (S) between the upper end of baffle plate 21 and the upper side of the anode compartment was 40 mm, as measured in a vertical direction.

Electrolytic solution distributor 28 employed is a square-shaped, pipe-like body having a shape as shown in FIGS. 9 and 11. Distributor 28 has a length of 220 cm and a cross-sectional area of 4 $cm^2$ in its hollow portion and has 24 electrolytic solution feed holes 23 each having a diameter of 2 mm which are formed at regular intervals. Distributor 28 has both ends thereof closed and has inlet nozzle 7 positioned in a side wall of an end portion thereof. Distributor 28 was horizontally disposed at a position 50 mm above the lower side of the anode compartment, and inlet nozzle 7 of distributor 28 was connected to the inner opening of inlet nozzle 10 (for an electrolytic solution) of the anode compartment. Each of electrolytic solution feed holes 23 of distributor 28 has a cross-sectional area such that, during the operation of the unit cell, when a saturated saline solution is supplied as an electrolytic solution through distributor 28 at a flow rate of 150 liters/hr (which is a minimum flow rate for conducting an electrolysis at a current density of 40 $A/dm^2$), each electrolytic solution feed holes 23 exhibits a pressure loss of about 150 $mm \cdot H_2O$.

Anode 13 was prepared by a method in which an anode active material comprising an oxide containing ruthenium, iridium and titanium is coated on a titanium expanded metal. Cathode 14 was prepared by a method in which a cathode active material comprising a nickel oxide is plasma-sprayed on a nickel expanded metal.

Ion change membrane 17 is the cation exchange membrane ACIPLEX (registered trademark) F4202 (manufactured and sold by Asahi Kasei Kogyo K. K., Japan). The distance between each pair of anode 13 and cathode 14 is about 2 mm.

Using the thus assembled bipolar, filter press type electrolytic cell, an electrolysis was conducted while feeding a 300 g/liter saline solution (as an anolyte) to the anode compartments so that the sodium chloride concentration at the outlet of the electrolytic cell became 200 g/liter and while feeding a diluted aqueous sodium hydroxide solution to the cathode compartments so that the sodium hydroxide concentration at the outlet of the electrolytic cell became 32% by weight. The electrolysis was performed for 10 days under conditions wherein the electrolysis temperature was 90° C., the electrolysis pressure was 0.14 MPa in terms of an absolute pressure, the current density was in the range of from 30 $A/dm^2$ to 60 $A/dm^2$.

The concentration distribution in the anolyte (i.e., the unevenness in the sodium chloride concentration of the anolyte) during the electrolysis was measured by sampling the anolyte at the below-described 9 points of the anode compartment, measuring the sodium chloride concentrations of the resultant samples and taking, as the unevenness, the difference between the maximum concentration and the minimum concentration. The 9 sampling points consist of 3 points which are 150 mm below the upper side of the anode compartment, one of which is at the middle of the distance between both lateral sides of the compartment and the other two of which are, respectively, at a distance of 100 mm from one lateral side and at a distance of 100 mm from the other lateral side; 3 points which are 600 mm below the upper side of the anode compartment, one of which is at the middle of the distance between both lateral sides of the compartment and the other two of which are, respectively, at a distance of 100 mm from one lateral side and at a distance of 100 mm from the other lateral side; and 3 points which are 1,000 mm below the upper side of the anode compartment, one of which is at the middle of the distance between both lateral sides of the compartment and the other two of which are, respectively, at a distance of 100 mm from one lateral side and at a distance of 100 mm from the other lateral side.

The vibrations in the electrolytic cell during the electrolysis were determined by the following method. One end of a pressure detection tube was inserted into the anode compartment, and the end of the pressure detection tube was held at a position 10 mm below the bottom wall of the anode-side gas-liquid separation chamber (i.e., at a position 10 mm below the upper side of the anode compartment). The other end of the pressure detection tube was connected to a pressure sensor. The pressure sensor was operated, and output data from the pressure sensor was analyzed by means of the analyzing recorder 3655E (manufactured and sold by Yokogawa Electric Corp., Japan). The difference between the maximum value and the minimum value of the pressure measured was taken as vibration.

The results of the measurement of the vibrations in the electrolytic cell and of the measurement of the unevenness in the sodium chloride concentration of the anolyte (concentration difference) are shown in Table 1. As shown in Table 1, it was found that, even when the current density was as high as 60 $A/dm^2$, the vibrations in the electrolytic cell (in terms of the height of a water column) were less than 5 $cm \cdot H_2O$, and the concentration difference in the anolyte was 0.35 N.

EXAMPLE 2

Electrolytic unit cells were provided, each of which had the same structure as in Example 1 except that the following modifications were made. Anode-side gas-liquid separation chamber 27 was constructed to have a structure as shown in FIG. 3. Specifically, anode-side gas-liquid separation chamber 27 was constructed by a method in which, after the same titanium plate as in Example 1 was fixed to perforated bottom wall 4A in the same manner as in Example 1, titanium expanded metal 2 (which was a perforated plate having the same opening area ratio and the same size of opening as in Example 1 and) which had the same width as the second passage B was horizontally fixed to the upper edge of the above-mentioned titanium plate, as shown in FIG. 3 wherein titanium expanded metal 2 horizontally extends from the upper edge of the titanium plate to wall 1. In addition, the height ($H^2$) of baffle plate 21 (having a structure as shown in FIG. 7) was changed to 400 mm.

Using such unit cells, an electrolytic cell was assembled in the same manner as in Example 1.

Using the electrolytic cell obtained, an electrolysis was performed under the same conditions as in Example 1.

The results of the measurement of the vibrations in the electrolytic cell and of the measurement of the unevenness in the sodium chloride concentration of the anolyte (concentration difference) are shown in Table 1. As shown in Table 1, it was found that, even when the current density was as high as 60 A/dm$^2$, the vibrations in the electrolytic cell (in terms of the height of a water column) were less than 5 cm·$H_2O$, and the concentration difference in the anolyte was 0.32 N.

EXAMPLE 3

Electrolytic unit cells were provided each of which had the same structure as in Example 1 except that baffle plate 21 and distributor 28 were not employed.

Using such unit cells, an electrolytic cell was assembled in the same manner as in Example 1.

Using the electrolytic cell obtained, an electrolysis was performed under the same conditions as in Example 1.

The results of the measurement of the vibrations in the electrolytic cell and of the measurement of the unevenness in the sodium chloride concentration of the anolyte (concentration difference) are shown in Table 1. As shown in Table 1, it was found that, even when the current density was as high as 60 A/dm$^2$, the vibrations in the electrolytic cell (in terms of the height of a water column) were less than 5 cm·$H_2O$, and the concentration difference in the anolyte was 0.95 N.

COMPARATIVE EXAMPLE 1

Electrolytic unit cells were provided each of which had the same structure as in Example 1 except that the following modifications were made.

Anode-side gas-liquid separation chamber 27 was constructed to have a structure as shown in FIG. 5. Specifically, anode-side gas-liquid separation chamber 27 was constructed by the following method. Perforation 5 of perforated bottom wall 4A of anode-side gas-liquid separation chamber 27 was formed by a method in which circular holes each having a diameter of 10 mm are formed at a pitch of 20 mm along the longitudinal central axis of bottom wall 4A. Perforated bottom wall 4A of anode-side gas-liquid separation chamber 27 had an opening area ratio of 11%. In addition, as shown in FIG. 5, the same perforated plate (titanium expanded metal 2) as in Example 1 was horizontally fixed to the inside walls of anode-side gas-liquid separation chamber 27 so that titanium expanded metal 2 was horizontally held at a position 2 mm above perforated bottom wall 4A of anode-side gas-liquid separation chamber 27.

Further, baffle plate 21 and distributor 28 were not employed.

Using such unit cells, an electrolytic cell was assembled in the same manner as in Example 1.

Using the electrolytic cell obtained, an electrolysis was performed under the same conditions as in Example 1.

The results of the measurement of the vibrations in the electrolytic cell and of the measurement of the unevenness in the sodium chloride concentration of the anolyte (concentration difference) are shown in Table 1. As shown in Table 1, the following was found. When the current density was 50 A/dm$^2$ the vibrations in the electrolytic cell (in terms of the height of a water column) were as large as 15 cm·$H_2O$. When the current density was 60 A/dm$^2$, the vibrations in the electrolytic cell were as large as 32 cm·$H_2O$. Further, when the current density was 60 A/dm$^2$, the concentration difference in the anolyte was as large as 0.93 N. These results show that the electrolytic cell used in Comparative Example 1 has problems in that, when the electrolysis is performed at high current density, great vibrations occur, and the concentration distribution in the anolyte (i.e., the unevenness in the concentration) becomes broad.

COMPARATIVE EXAMPLE 2

Electrolytic unit cells were provided each of which had the same structure as in Example 1 except that the following modifications were made.

Any partition wall was not disposed in anode-side gas-liquid separation chamber 27 . In addition, perforation 5 of perforated bottom wall 4A of anode-side gas-liquid separation chamber 27 was formed by a method in which circular holes each having a diameter of 10 mm are formed at a pitch of 20 mm along the longitudinal central axis of bottom wall 4A. Perforated bottom wall 4A of anode-side gas-liquid separation chamber 27 had an opening area ratio of 11%.

(The same baffle plate and the same distributor as in Example 1 were employed.)

Using such unit cells, an electrolytic cell was assembled in the same manner as in Example 1.

Using the electrolytic cell obtained, an electrolysis was performed under the same conditions as in Example 1.

The results of the measurement of the vibrations in the electrolytic cell and of the measurement of the unevenness in the sodium chloride concentration of the anolyte (concentration difference) are shown in Table 1. As shown in Table 1, the following was found. When the current density was 50 A/dM$^2$, the vibrations in the electrolytic cell (in terms of the height of a water column) were as large as 21 cm·$H_2O$. When the current density was 60 A/dm$^2$, the vibrations in the electrolytic cell were as large as 38 cm·$H_2O$. When the current density was 60 A/dm$^2$, the concentration difference in the anolyte was 0.37 N. These results show that the electrolytic cell used in Comparative Example 2 has a problem in that, when the electrolysis is performed at high current density, great vibrations occur.

TABLE 1

| | Current density (Å/dm$^2$) | | | |
|---|---|---|---|---|
| | 30 | 40 | 50 | 60 |
| Vibration (cm.$H_2O$) | | | | |
| Example 1 | less than 5 | less than 5 | less than 5 | less than 5 |
| Example 2 | less than 5 | less than 5 | less than 5 | less than 5 |
| Example 3 | less than 5 | less than 5 | less than 5 | less than 5 |
| Comparative Example 1 | less than 5 | 5 | 15 | 32 |
| Comparative Example 2 | less than 5 | 9 | 21 | 38 |
| Concentration difference in the anolyte (N)*) | | | | |
| Example 1 | 0.17 | 0.21 | 0.27 | 0.35 |
| Example 2 | 0.16 | 0.21 | 0.26 | 0.32 |
| Example 3 | 0.49 | 0.68 | 0.81 | 0.95 |
| Comparative Example 1 | 0.52 | 0.66 | 0.78 | 0.93 |
| Comparative Example 2 | 0.19 | 0.23 | 0.27 | 0.37 |

*)"Concentration difference in the anolyte" means the difference between the maximum concentration and the minimum concentration in the anolyte.

INDUSTRIAL APPLICABILITY

The unit cell of the present invention for use in a bipolar, filter press type electrolytic cell is advantageous in that a gas and an electrolytic solution can be discharged in a condition wherein the gas and the electrolytic solution are substantially completely separated from each other, so that, even when the electrolysis is performed at a current density as high as, for example, 50 A/dm$^2$ or more, the occurrence of vibrations in the cell can be greatly suppressed, thereby preventing the occurrence of the adverse effects of vibrations, such as the occurrence of a breakage of an ion exchange membrane.

Further, when the unit cell of the present invention has, at least in the anode compartment of the anode and cathode compartments, a baffle plate and/or an electrolytic solution distributor, the circulation of the electrolytic solution in the anode compartment can be efficiently facilitated, so that, even when the electrolysis is performed at a current density as high as, for example, 50 A/dm$^2$ or more, the concentration distribution in the electrolytic solution in the anode compartment can be caused to remain narrow, thereby enabling an efficient electrolysis.

What is claimed:

1. In a unit cell for use in a bipolar, filter press type, aqueous alkali metal chloride solution electrolytic cell comprising a plurality of unit cells which are arranged in series through a cation exchange membrane disposed between respective adjacent unit cells, each unit cell comprising:

an anode-side pan-shaped body having an anode compartment and an anode-side gas-liquid separation chamber which is disposed in an anode-side non-current flowing space left above said anode compartment and extends over the entire length of the upper side of said anode compartment, and a cathode-side pan-shaped body having a cathode compartment and a cathode-side gas-liquid separation chamber which is disposed in a cathode-side non-current flowing space left above said cathode compartment and extends over the entire length of the upper side of said cathode compartment, said anode-side pan-shaped body and said cathode-side pan-shaped body being disposed back to back, said anode-side and cathode-side gas-liquid separation chambers having perforated bottom walls separating said anode-side and cathode-side gas-liquid separation chambers from said anode compartment and said cathode compartment, respectively, and each of said gas-liquid separation chambers having, at one end thereof, a gas and liquid outlet nozzle, the improvement comprising a bubble removing partition wall which is disposed at least in said anode-side gas-liquid separation chamber of said anode-side and cathode-side gas-liquid separation chambers and which extends upwardly of the perforated bottom wall of the gas-liquid separation chamber, said bubble removing partition wall extending along the entire length of said gas-liquid separation chamber to partition said gas-liquid separation chamber into a first passage A formed on said bottom wall in a perforated area thereof and a second passage B formed on said bottom wall in a non-perforated area thereof, said bubble removing partition wall having an apertured segment having a plurality of apertures, wherein the aperture ratio of said apertured segment is in the range of from 30 to 70%, based on the area of the apertured segment, and the average area of the apertures of said apertured segment is in the range of from 3 to 60 mm$^2$, the apertures of said apertured segment of the bubble removing partition wall being positioned at least 10 mm above the inside surface of the bottom wall of the gas-liquid separation chamber, wherein said second passage B communicates with said gas and liquid outlet nozzle and wherein said second passage B communicates with the anode compartment through said apertured segment and said first passage A.

2. The unit cell according to claim 1, which further comprises, at least in the anode compartment of the anode and cathode compartments, a baffle plate disposed in an upper portion of the anode compartment, wherein said baffle plate is positioned so that an upward flow passage C is formed between said baffle plate and the anode and a downward flow passage D is formed between said baffle plate and a back-side inner wall of the anode compartment.

3. The unit cell according to claim 2, wherein:

said baffle plate has a height of from 300 mm to 600 mm, said upward flow passage C has a broader width at a lower end thereof than at an upper end thereof, and has a width in the range of from 5 mm to 15 mm as measured at the smallest spacing between the baffle plate and the anode, and said downward flow passage D has a broader width at an upper end thereof than at a lower end thereof, and has a width in the range of from 1 mm to 20 mm as measured at the smallest spacing between the baffle plate and the back-side inner wall of the anode compartment.

4. The unit cell according to any one of claims 1 to 3, which further comprises, at least in the anode compartment of the anode and cathode compartments, an electrolytic solution distributor having a pipe-like morphology and disposed in a lower portion of the anode compartment, said distributor having a plurality of electrolytic solution feed holes and having an inlet communicating with an electrolytic solution inlet nozzle of the anode compartment, wherein each of said electrolytic solution feed holes has a cross-sectional area such that, during the operation of the unit cell, when a saturated saline solution is supplied as an electrolytic solution through said distributor at a minimum flow rate for conducting an electrolysis at a current density of 40 A/dm$^2$, each electrolytic solution feed hole exhibits a pressure loss of from 50 mm·$H_2O$ to 1,000 mm·$H_2O$.

* * * * *